US008241824B2

(12) United States Patent
Itami

(10) Patent No.: US 8,241,824 B2
(45) Date of Patent: Aug. 14, 2012

(54) ELECTROPHOTOGRAPHIC PHOTORECEPTOR, IMAGE FORMING METHOD, IMAGE FORMING APPARATUS AND PROCESS CARTRIDGE

(75) Inventor: Akihiko Itami, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 133 days.

(21) Appl. No.: 12/817,684

(22) Filed: Jun. 17, 2010

(65) Prior Publication Data

US 2010/0330480 A1 Dec. 30, 2010

(30) Foreign Application Priority Data

Jun. 24, 2009 (JP) ..... 2009-149694

(51) Int. Cl.
*G03G 5/00* (2006.01)

(52) U.S. Cl. ..... 430/58.65; 430/58.75; 430/59.5; 399/159

(58) Field of Classification Search ..... 430/58.65, 430/58.75, 59.5; 399/159
See application file for complete search history.

(56) References Cited

U.S. PATENT DOCUMENTS

2008/0292981 A1* 11/2008 Toda et al. ..... 430/58.65

FOREIGN PATENT DOCUMENTS

| | | |
|---|---|---|
| JP | 2000105479 | 4/2000 |
| JP | 2000250239 | 9/2000 |
| JP | 2007108314 | 4/2007 |

* cited by examiner

*Primary Examiner* — Mark A Chapman
(74) *Attorney, Agent, or Firm* — Lucas & Mercanti, LLP

(57) ABSTRACT

An electrophotographic photoreceptor comprising an electrically conductive support having thereon a photo sensitive layer having a laminated structure comprising a charge generation layer and a charge transport layer, wherein the charge generation layer comprises a titanyl phthalocyanine pigment having a crystal structure exhibiting the following peaks of Bragg angles 2θ (±0.2°) of X-ray powder diffraction employing a characteristic X-ray of a CuKα radiation (having a wavelength of 1.542 Å): at least a largest diffraction peak at 27.2°, major diffraction peaks at 9.4°, 9.6° and 24.0°, and a diffraction peak of a lowest angle at 7.3° while exhibiting no peak between the peaks of 7.3° and 9.4° and no peak at 26.3°; and the charge transport layer comprises a compound represented by Formula (1) or (2), wherein A, B, C and D are not simultaneously a hydrogen atom:

Formula (1)

Formula (2)

15 Claims, 4 Drawing Sheets

ELECTROPHOTOGRAPHIC PHOTORECEPTOR, IMAGE FORMING METHOD, IMAGE FORMING APPARATUS AND PROCESS CARTRIDGE

This application is based on Japanese Patent Application No. 2009-149694 filed on Jun. 24, 2009 in Japanese Patent Office, the entire content of which is hereby incorporated by reference.

FIELD OF THE INVENTION

The present invention relates to an electrophotographic photoreceptor (hereafter, also referred to merely as a photoreceptor), an image formation method, an image formation apparatus, and a process cartridge used for an electrophotographic image formation, and, in more detail, relates to an electrophotographic photoreceptor, an image formation method, an image formation apparatus and a process cartridge used for the electrophotographic image formation employed in the field of a copier or a printer.

BACKGROUND OF THE INVENTION

Recently, there have been increased opportunities of using electrophotographic copiers or printers in the field of printing or color printing. There is a strong trend of requiring high quality digital black-and-white or color images in such fields of printing or color printing. In response to such a requirement, there has been proposed formation of high precision digital images by use of a short wavelength laser light (Patent Documents 1 and 2). However, the current condition is that even when forming a precise electrostatic latent image on an electrophotographic photoreceptor by use of a short wavelength laser light and reducing the exposure diameter, the finally obtained electrophotographic image does not achieve sufficiently high image quality.

The cause thereof is due to the fact that there were not sufficiently addressed newly generated problems in images obtained by imagewise exposure at relatively short wavelengths.

As a first problem, in a conventional photoreceptor developed for a longer wavelength laser light, light transmittance for a shorter wavelength laser light has not been fully enough, whereby no excellent sensitivity characteristics has been obtained. This is due to the light absorption range of a charge transport material extended to a portion of 400 nm or more. As a result, no uniform picture image cannot be obtained, for example, due to the effect of an uneven film thickness. On the other hand, a charge transport material which does not substantially have absorption in 400 nm or more had a problem in image stability because of the inferior light stability of the charge transport material. It was found by the present inventor that this problem can be overcome by employing a prescribed charge transport material as disclosed in Patent Document 3.

As a second problem, the transfer current increases as the diameter of the toner is decreased in order to obtain a higher quality image employing a short wavelength laser. When the transfer current is increased, a problem of transfer memory tends to occur in the photoreceptor. Specifically, in a photoreceptor employing a phthalocyanine pigment as a charge generation material, the transfer memory is easy to occur.

| | |
|---|---|
| Patent Document 1 | Japanese Patent Application Publication Open to Public Inspection (hereafter referred to as JP-A) No. 2000-250239 |
| Patent Document 2 | JP-A No. 2000-105479 |
| Patent Document 3 | JP-A No. 2007-108314 |

SUMMARY OF THE INVENTION

An object of the present invention is to provide an electrophotographic photoreceptor in which deterioration of the stability in potential due to light degradation and due to repeated use is prevented while exhibiting a high transfer property and an excellent suppression effect of a transfer memory even when a high density electrostatic latent image is formed on the electrophotographic photoreceptor by using light of a wavelength of 350-500 nm, as well as to provide an image forming method, an image forming apparatus and a process cartridge, each employing aforementioned electrophotographic photoreceptor.

It was found in the present invention that, by simultaneously employing (i) a charge generation material having a prescribed crystal structure and a suitable particle diameter, and (ii) a prescribed charge transfer material exhibiting an excellent transmittance of light having a shorter wavelength, an electrophotographic photoreceptor which simultaneously overcomes the above first and second problems, improves the transmittance of light of a short wavelength laser (sensitivity to light of a short wavelength laser), prevents deterioration of the stability in electric potential due to light degradation and due to repeated use, and improves the problem of a transfer memory, can be obtained.

The aforementioned object of the present invention is attained by the following structures.

1. An electrophotographic photoreceptor comprising an electrically conductive support having thereon a photo sensitive layer having a laminated structure comprising a charge generation layer and a charge transport layer, wherein the charge generation layer comprises a titanyl phthalocyanine pigment having a crystal structure exhibiting the following peaks of Bragg angles 20 (±0.2°) of X-ray powder diffraction employing a characteristic X-ray of a CuKα radiation (having a wavelength of 1.542 Å):

at least a largest diffraction peak at 27.2°, major diffraction peaks at 9.4°, 9.6° and 24.0°, and a diffraction peak of a lowest angle at 7.3° while exhibiting no peak between the peaks of 7.3° and 9.4° and no peak at 26.3°; and the charge transport layer comprises a compound represented by Formula (1) or (2):

Formula (1)

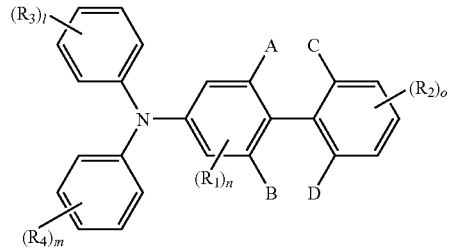

wherein $R_1$ and $R_2$ each represent an alkyl group having 1-5 carbon atoms or an alkoxy group having 1-5 carbon atoms; $R_3$ and $R_4$ each represent a substituted or non-substituted alkyl group having 1-5 carbon atoms or a substituted or non-substituted alkoxy group having 1-5 carbon atoms; n represents an integer of 0-2; o represents an integer of 0-3; l and m each represent an integer of 0-5; and A, B, C and D each represent a hydrogen atom, a substituted or non-substituted alkyl group, a substituted or non-substituted alkoxy group or a substituted or non-substituted aryl group, provided that A, B, C and D are not simultaneously a hydrogen atom, Formula (2)

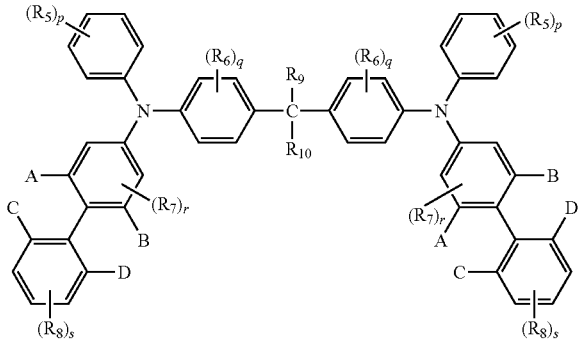

wherein $R_5$, $R_6$, $R_7$ and $R_8$ each represent an alkyl group having 1-5 carbon atoms or an alkoxy group having 1-5 carbon atoms; p represents an integer of 0-5; q represents an integer of 0-4; r represents an integer of 0-2; s represents an integer of 0-3; $R_9$ and $R_{10}$ each represent an group or an aryl group; $R_9$ and $R_{10}$ may be combined to form a ring; and A, B, C and D each are the same as A, B, C and D, respectively, defined in Formula (1), provided that A, B, C and D are not simultaneously a hydrogen atom.

2. The electrophotographic photoreceptor of Item 1 comprising an intermediate layer containing at least N-type semiconductor particles between the electroconductive support and the charge generation layer.

3. A method of image forming comprising the steps of:

providing a uniform charge potential over an electrophotographic photoreceptor;

exposing the electrophotographic photoreceptor provided with the charge potential to light having a wavelength of 350-500 nm to form an electrostatic latent image;

developing the electrostatic latent image to form a toner image; and transferring the toner image to a transfer medium, wherein the electrophotographic photoreceptor of Item 1 or 2 is employed as the electrophotographic photoreceptor.

4. An image forming apparatus employing the method of image forming of Item 3.

5. A process cartridge used for an image forming apparatus of Item 4, wherein the process cartridge comprises the electrophotographic photoreceptor of Item 1 or 2 and at least one of a charging member, an imagewise exposing member and a developing member to be unified in a body; and the process cartridge is designed so as to be easily installed into or removed from the image forming apparatus.

DESCRIPTION OF THE PREFERRED EMBODIMENTS

Figure 1:
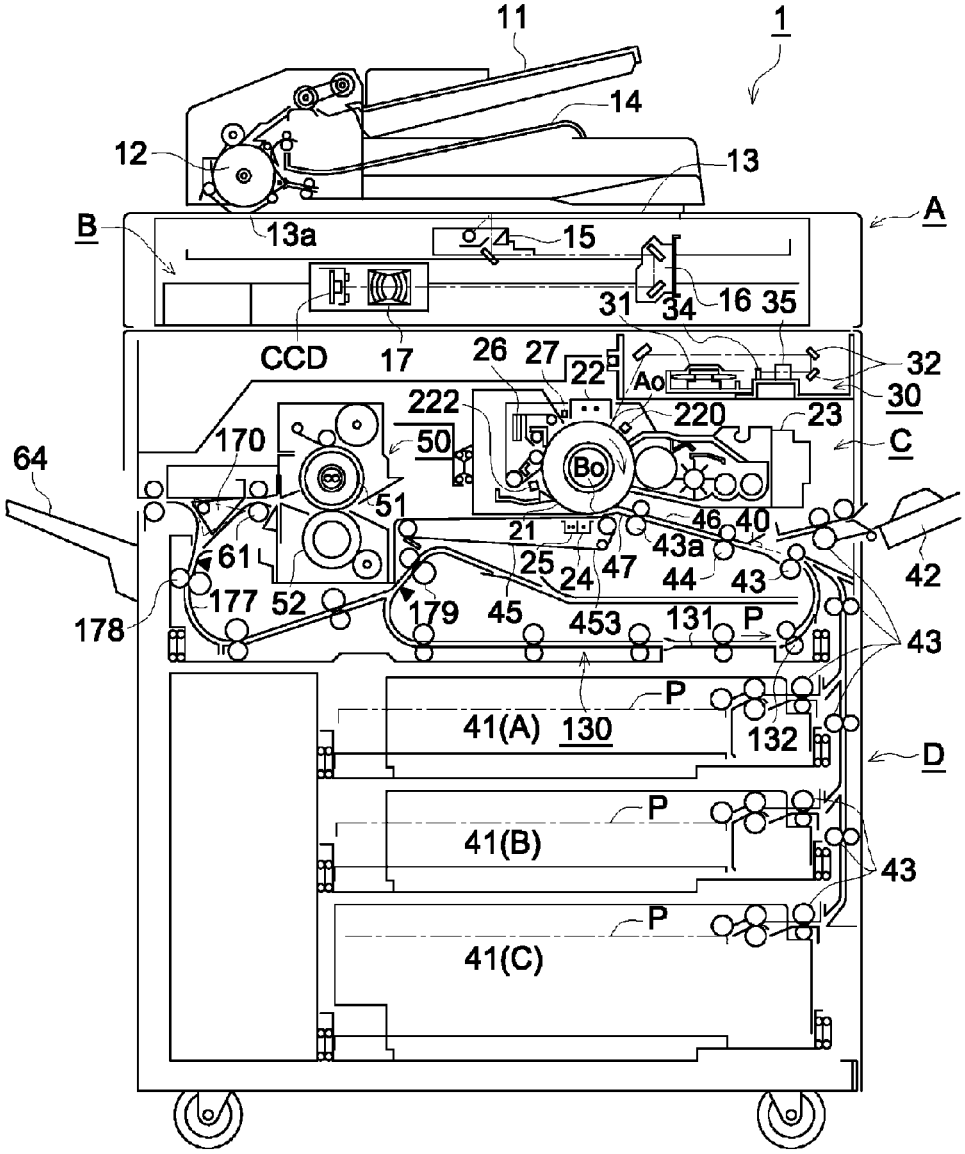
FIG. 1 shows a schematic diagram illustrating functions of an image forming apparatus according to the present invention.

According to the present invention, provided is an electrophotographic photoreceptor in which deterioration of the stability in potential due to light degradation and due to repeated use is prevented while providing a high density dot image and exhibiting an excellent suppression effect of a transfer memory even when a high density electrostatic latent image is formed on the electrophotographic photoreceptor by using light of a wavelength of 350-500 nm, as well as an image forming method, an image foaming apparatus and a process cartridge, each employing aforementioned electrophotographic photoreceptor, can be provided.

The embodiments to carry out the present invention will be described below, however, the present invention is not limited thereto.

Hereafter, the electrophotographic photoreceptor of the present invention will be described in detail.

The electrophotography photoreceptor of the present invention is characterized in that the electrophotography photoreceptor comprises an electrically conductive support having thereon a photo sensitive layer having a laminated structure comprising a charge generation layer and a charge transport layer, wherein the charge generation layer comprises a titanyl phthalocyanine pigment having a crystal structure exhibiting the following peaks of Bragg angles 2θ (±0.2°) of X-ray powder diffraction employing a characteristic X-ray of a CuKα radiation (having a wavelength of 1.542 Å): at least a largest diffraction peak at 27.2°, major diffraction peaks at 9.4°, 9.6° and 24.0°, and a diffraction peak of a lowest angle at 7.3° while exhibiting no peak between the peaks of 7.3° and 9.4° and no peak at 26.3°; and the charge transport layer comprises a compound represented by above Formula (1) or (2).

In the electrophotographic photoreceptor of the present invention, by having the above structures, when a high density electrostatic latent image is formed on the electrophotographic photoreceptor by using light of a wavelength of 350-500 nm, deterioration of the stability in potential due to light degradation and due to repeated use can be prevented, and simultaneously a transfer memory can be suppressed, whereby a high density dot image can be formed.

The titanyl phthalocyanine pigment according to the present of the invention is a pigment of a compound having the following chemical structure.

Formula (3)

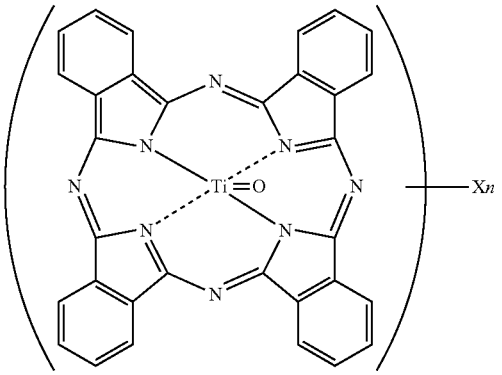

wherein X represents a halogen atom, and n represents 0-2. When above X is a chlorine atom, n is preferably 0-0.5, and more preferably 0-0.1.

The titanyl phthalocyanine pigment according to the present invention has the aforementioned crystalline feature in the X-ray diffraction spectrum employing CuKα radiation as a radiation source. The technique which applied the titanyl phthalocyanine pigment of this crystal form to a electrophotography photoreceptor has been disclosed, for example, in JP-A No. 2006-276829.

However, when the photoreceptor employing the titanyl phthalocyanine pigment of this crystal form is used in an image forming method in which an imagewise exposure employing light of a short wavelength laser (emitting light of wavelength of 350 nm-500 nm) is carried out, deterioration of sensitivity under repeated use or occurrence of transfer memory tends to occur. In the present invention, as the result of intensive investigation, it was found that these problems can be overcome by laminating a charge transport layer containing a compound represented by above Formula (1) or (2) on the charge generation layer containing the titanyl phthalocyanine pigment having the aforementioned crystal structure.

The method of preparing the titanyl phthalocyanine pigment having the aforementioned crystal structure has been disclosed, for example, in JP-A No. 2006-276829.

The method to obtain the crystal structure of the titanyl phthalocyanine pigment according to the present invention and description of the compound represented by Formula (1) or (2) will be mentioned below.

(Method to Obtain the Crystal Structure of the Titanyl Phthalocyanine Pigment According to the Present Invention)

The synthetic method of a titanyl phthalocyanine crystal of having the prescribed crystal structure employed in the present invention here will be described.

The synthesis method of a crude titanyl phthalocyanine crystal will be described. The synthetic method of a phthalocyanine compound has been known for many years.

For example, a method to heat a mixture of a phthalic anhydride, a metal or a metal halide and urea under existence or non-existence of a high boiling point solvent may be cited as a 1st method. In this case, a catalyst, such as an ammonium molybdate, is used together if needed. As a 2nd method, a ng point solvent may be cited. This method is used for phthalocyanine compounds, for example, aluminum phthalocyanine, indium phthalocyanine, oxo-vanadium phthalocyanine, oxo-titanium phthalocyanine and zirconium phthalocyanine, which cannot be synthesized by the 1st method. In a 3rd method, a phthalic anhydride or a phthalonitrile is reacted first with ammonia to form, for example, an intermediate such as 1,3-diiminoisoindrine, followed by heating with a metal halide in a high boiling point solvent. In a 4th method, a phthalonitrile compound is reacted with a metal alkoxide under existence of such as urea. The 4th method is an extremely useful method as a synthetic method of an electrophotographic material and extremely effectively used in the present invention, because halogenation (chlorination) of a benzene ring hardly occurs.

Next, a synthetic method of an amorphous titanyl phthalocyanine (low crystallinity titanyl phthalocyanine) will be described. This method includes dissolving phthalocyanine in a sulfuric acid, and diluting with water to re-deposit the crystal. An acid paste method or an acid slurry method can be applied for this method.

As a concrete method, the aforementioned crude material is dissolved in concentrated sulfuric acid of an amount of 10-50 times, insoluble matter is removed by filtering if necessary, and the product is gradually added to thoroughly cooled water or ice water of an amount of 10-50 times of the amount of the sulfuric acid to re-deposit titanyl phthalocyanine. After filtering the deposited titanyl phthalocyanine, it is washed with ion-exchanged water followed by filtering. This procedure is repeated until the filtrate exhibits neutrality. Finally, the product is washed with clean ion-exchanged water, and then filtered to obtain a water paste having a solid content of 5-15% by mass.

It is important to reduce the amount of residual sulfuric acid as small as possible by thoroughly washing the deposit with ion-exchanged water. Specifically, it is preferable that the ion-exchanged water after washing shows the following property values. Namely, the amount of residual sulfuric acid can be expressed in terms of a pH value or a specific conductance of the ion-exchanged water after washing. When it is expressed with a pH value, it is desirable that the pH value is in the range of 6-8. When the pH value is in this range, it can be concluded that the amount of residual sulfur is an amount which hardly affect the property of the photoreceptor. When the amount of residual sulfuric acid is expressed with a specific conductance, it is desirable that the specific conductance is not more than 8 μS/cm, more preferably not more than 6 μS/cm and still more preferably not more than 3 μS/cm. When the specific conductance is in this range, it can be concluded that the amount of residual sulfur is an amount which hardly affect the property of the photoreceptor. The pH value or the specific conductance of out of the above range is not preferred since the amount of residual sulfuric acid is too large, whereby the chargeability of the photoreceptor may be lowered or the light sensitivity may be deteriorated.

The titanyl phthalocyanine thus prepared an amorphous titanyl phthalocyanine (low crystallinity titanyl phthalocyanine). It is preferable that the amorphous titanyl phthalocyanine (low crystallinity titanyl phthalocyanine) exhibits at least a largest peak in 7.0°-7.5° of diffraction peaks (±0.2°) of Bragg angles 2θ in X-ray diffraction employing a characteristic X-ray of a CuKα radiation (having a wavelength of 1.542 Å). It is specifically preferable that the half height width of the diffraction peak is 1° or more. Further, it is preferable that the average particle diameter of the primary particles is 0.1 μm or less.

Next, the transformation method of the crystal will be described.

The transformation of the crystal is a process in which the aforementioned amorphous titanyl phthalocyanine (low crystallinity titanyl phthalocyanine) is transformed into a crystalline titanyl phthalocyanine having a crystal structure exhibiting the following Bragg angles 2θ (±0.2°) of X-ray diffraction employing a characteristic X-ray of a CuKα radiation (having a wavelength of 1.542 Å):

at least a largest diffraction peak at 27.2°,
major diffraction peaks at 9.4°, 9.6° and 24.0°, and
a diffraction peak of a lowest angle at 73° while exhibiting no peak between the peaks of 7.3° and 9.4° and no peak at 26.3°.

As a specific method, aforementioned amorphous titanyl phthalocyanine (low crystallinity titanyl phthalocyanine) without drying is mixed with an organic solvent under existence of water and stirred to obtain the aforementioned crystal structure.

As the organic solvent used in this process, any organic solvent may be used as far as a desired crystal structure is obtained, however, a preferable result is obtained when one of tetrahydrofuran, toluene, methylene chloride, carbon disulfide, o-dichlorobenzene and 1,1,2-trichloroethane is selected. These organic solvents is preferably used alone, however, a mixture of two or more of these organic solvents or a mixture of one of the above organic solvents and other solvent may be used. The amount of the aforementioned organic solvent used for transformation of the crystal structure is preferably 10 times or more and more preferably 30 times or more of the mass of the amorphous titanyl phthalocyanine (low crystallinity titanyl phthalocyanine). This is because the crystal structure can be quickly transformed and because the impurity contained in the amorphous titanyl phthalocyanine (low crystallinity titanyl phthalocyanine) can be fully removed. The amorphous titanyl phthalocyanine (low crystallinity titanyl phthalocyanine) used herein is prepared via an acid paste method. It is preferable to use an amorphous titanyl phthalocyanine (low crystallinity titanyl phthalocyanine) from which sulfuric acid is fully removed as aforementioned. When the transformation of the crystal structure is carried out while sulfuric acid is remained, ions of sulfuric acid remain in the crystal particles which cannot be fully removed even when the procedure described in the washing process is conducted. When sulfuric acid is remained in the crystal, the sensitivity and chargeability of the photoreceptor may be lowered. For example, a method to transform the crystal structure by pouring a titanyl phthalocyanine dissolved in sulfuric acid into an organic solvent together with ion-exchanged water has been disclosed. In this method, a titanyl phthalocyanine exhibiting X-ray diffraction peaks similar to the peaks observed in the titanyl phthalocyanine of the present invention. However, the concentration of sulfuric acid ion in the titanyl phthalocyanine is high, resulting in the inferior light attenuation property (light sensitivity), whereby being unfavorable as a preparation method of a titanyl phthalocyanine of the present invention.

Next, aforementioned compound represented by Formula (1) or (2) used for a charge transport layer will be described.

In above Formula (1), $R_1$ and $R_2$ each represent each represent an alkyl group having 1-5 carbon atoms or an alkoxy group having 1-5 carbon atoms; $R_3$ and $R_4$ each represent a substituted or non-substituted alkyl group having 1-5 carbon atoms or a substituted or non-substituted alkoxy group having 1-5 carbon atoms; n represents an integer of 0-2; o represents an integer of 0-3; l and m each represent an integer of 0-5; and A, B, C and D each represent a hydrogen atom, a substituted or non-substituted alkyl group, a substituted or non-substituted alkoxy group or a substituted or non-substituted aryl group, provided that A, B, C and D are not simultaneously a hydrogen atom.

Examples of an alkyl group represented by $R_1$ or $R_2$ include a methyl group, an ethyl group, a propyl group, a butyl group and a pentyl group. Examples of an alkoxy group represented by $R_1$ or $R_2$ include a methoxy group, an ethoxy group, a propoxy group, a butoxy group and a pentoxy group.

Examples of an alkyl group represented by $R_3$ or $R_4$ include a methyl group, an ethyl group, a propyl group, a butyl group, a pentyl group and a cyclohexyl group. Examples of an alkoxy group represented by $R_3$ or $R_4$ include a methoxy group, an ethoxy group, a propoxy group, a butoxy group and a pentoxy group. As a substituted alkyl group represented by $R_3$ or $R_4$, a phenyl substituted alkyl group is cited.

Examples of a substituent of an alkyl group, an alkoxy group and an aryl group represented by any one of A-D include an alkyl group and an alkoxy group.

Examples of an alkyl group represented by any one of A-D include: alkyl groups having 1-4 carbon atoms such as a methyl group, an ethyl group, an n-propyl group, an isopropyl group, an n-butyl group and a t-butyl group; and substituted alkyl groups such as an alkoxy alkyl group, a benzyl group and a phenethyl group. Examples of an alkoxy group include a methoxy group, an ethoxy group and a propoxy group. A phenyl group is cited as an aryl group.

Specific examples of the compound represented by Formula (1) will be given below.

(CTM1)

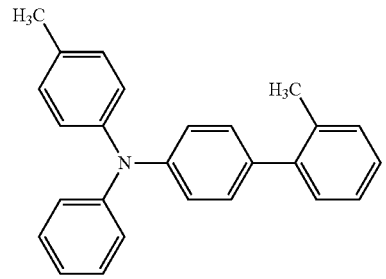

(CTM2)

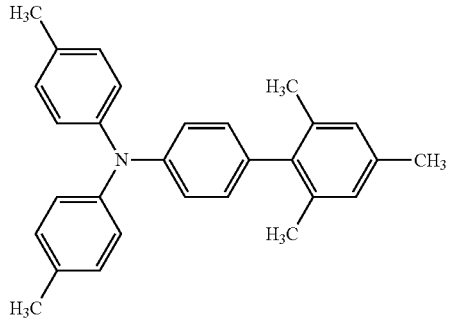

(CTM3)

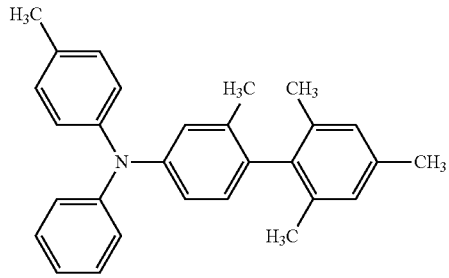

(CTM4)

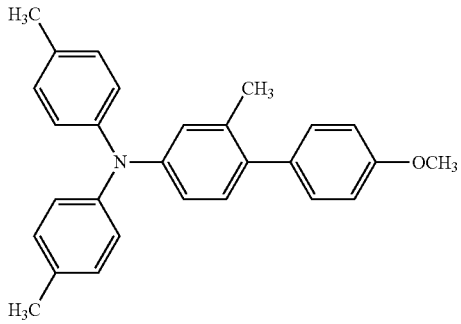

(CTM5)

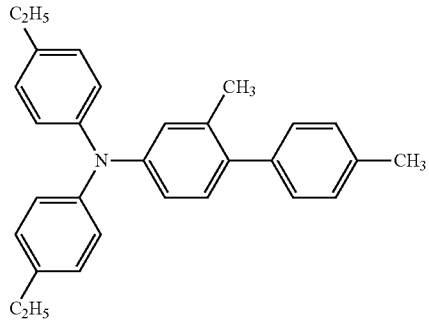

-continued
(CTM6)
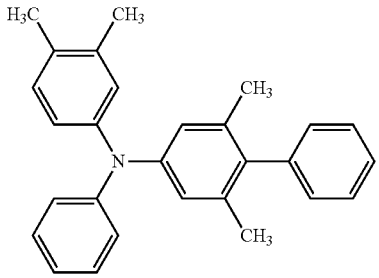
(CTM7)
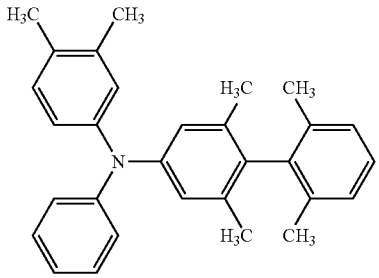
(CTM8)
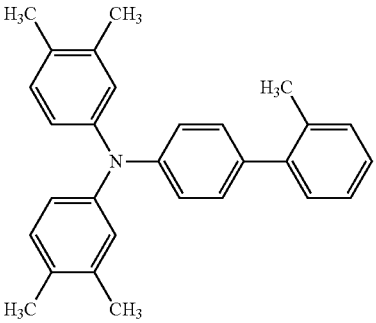
(CTM9)
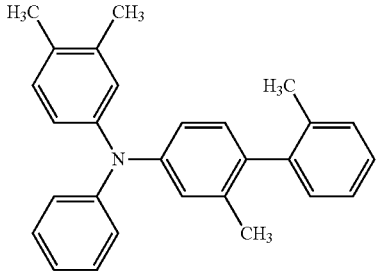
(CTM10)
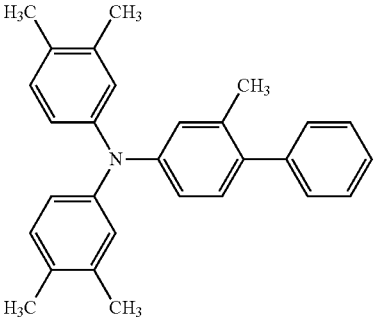
-continued
(CTM11)
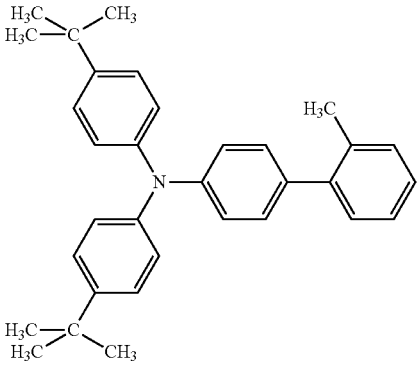
(CTM12)
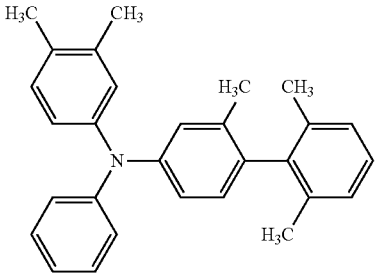
(CTM13)
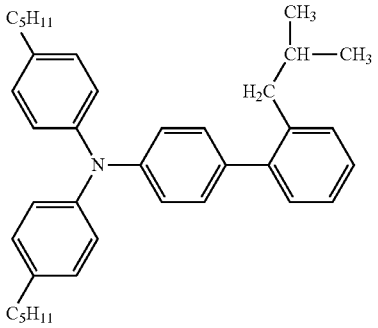
(CTM14)
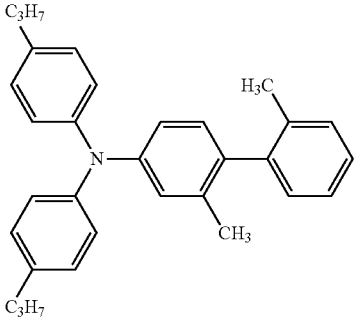
(CTM15)
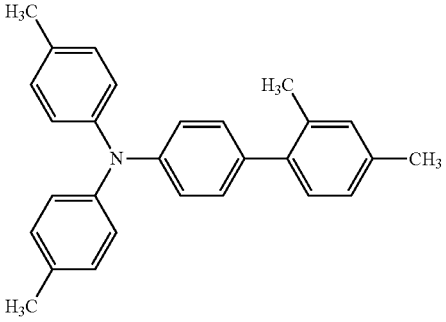

-continued (CTM16)

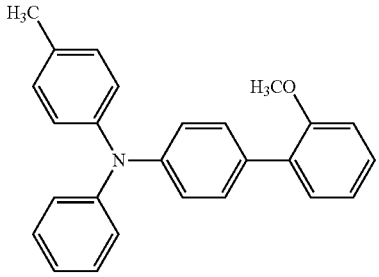

(CTM17)

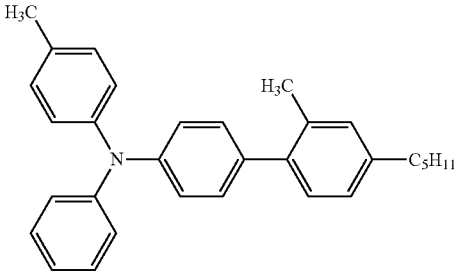

(CTM18)

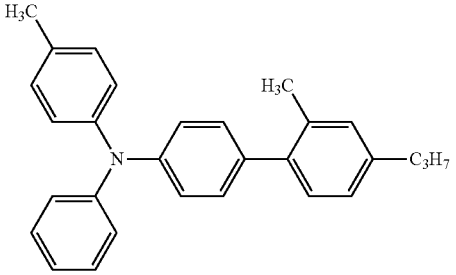

(CTM19)

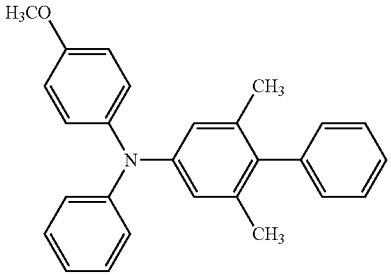

-continued (CTM20)

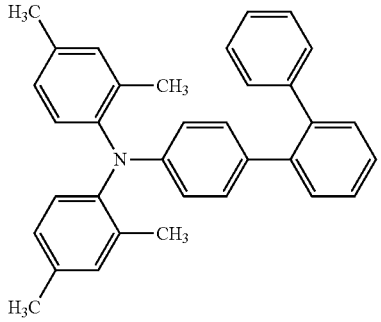

A compound represented by Formula (1) can be synthesized via an Ullmann reaction employing diphenylamine and an aryl halide using copper and an alkali as catalyst, or via a Suzuki coupling method using a palladium catalyst.

The compound represented by Formula (2) will be described.

In Formula (2), $R_5$, $R_6$, $R_7$ and $R_8$ each represent an alkyl group having 1-5 carbon atoms or an alkoxy group having 1-5 carbon atoms; p represents an integer of 0-5; q represents an integer of 0-4; r represents an integer of 0-2; s represents an integer of 0-3; $R_9$ and $R_{10}$ each represent an alkyl group or an aryl group; $R_9$ and $R_{10}$ may be combined to form a ring; and A, B, C and D each are the same as A, B, C and D, respectively, defined in Formula (1), provided that A, B, C and D are not simultaneously a hydrogen atom.

The examples of an alkyl group and an alkoxy group represented by any one of $R_5$, $R_6$, $R_7$ and $R_8$ are the same as the examples of an alkyl group and an alkoxy group cited for to $R_1$ and $R_2$.

As an alkyl group represented by $R_9$ or $R_{10}$, a methyl group, an ethyl group, a propyl group, a butyl group or a pentyl group may be cited. As a ring structure formed by combining $R_9$ and $R_{10}$, a cyclohexyl group or a cyclopentyl group may be cited. Further, as an aryl group, a phenyl group maybe cited.

Specific examples of the compound represented by Formula (2) will be given below.

(CTM21)

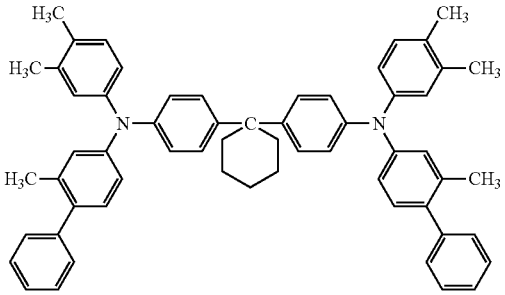

(CTM22)

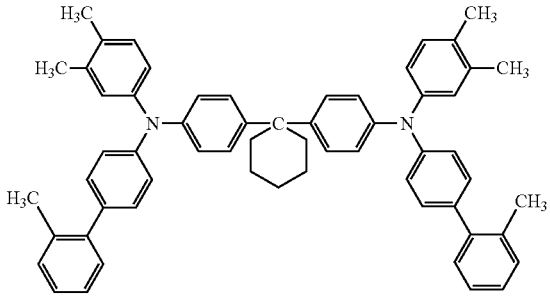

-continued
(CTM23)
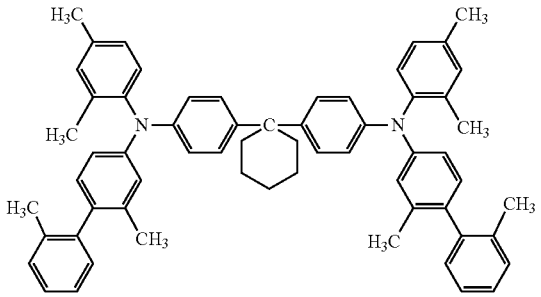
(CTM24)
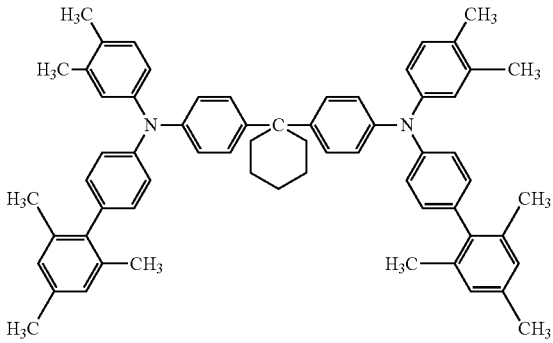
(CTM25)
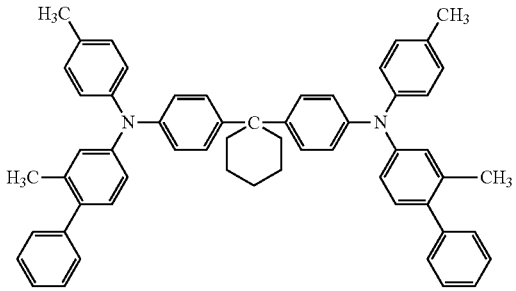
(CTM26)
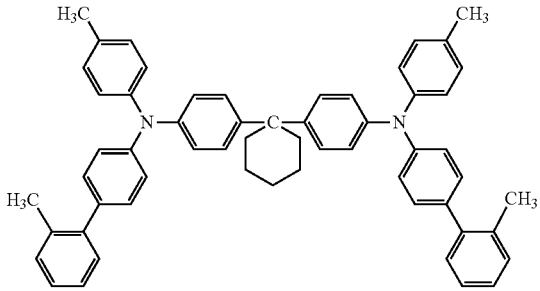
(CTM27)
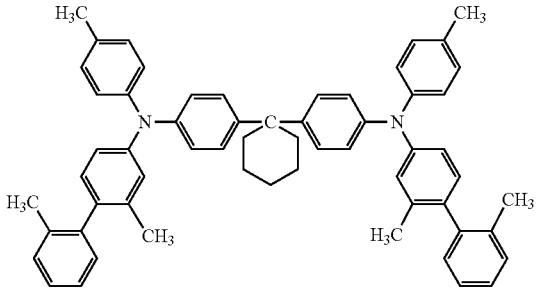
(CTM28)
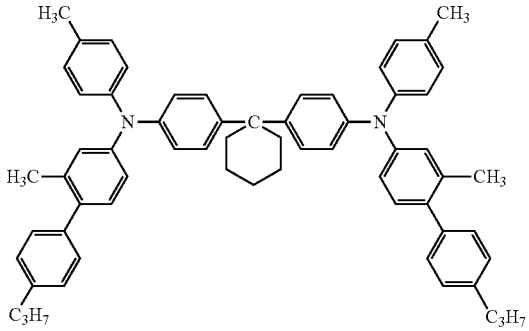
(CTM29)
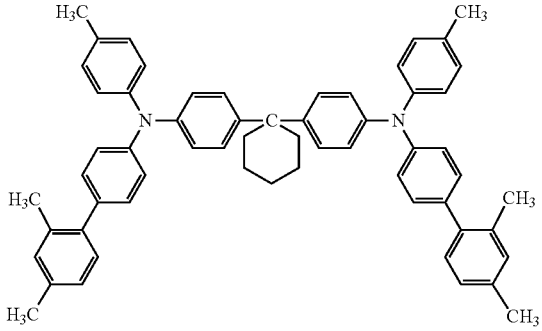
(CTM30)
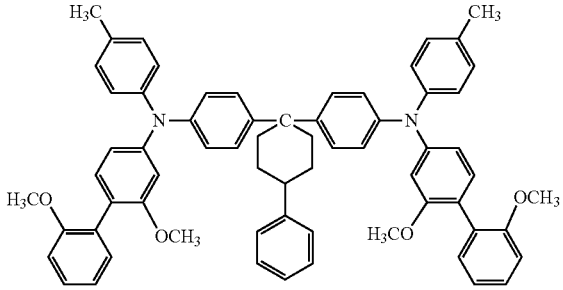

-continued
(CTM31)
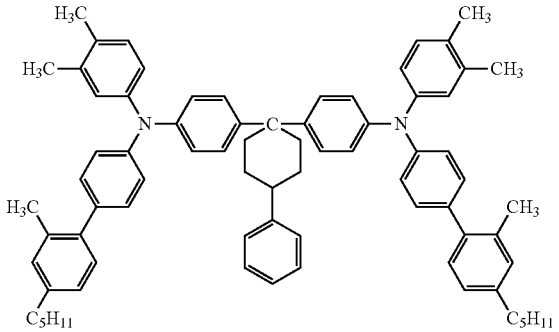
(CTM32)
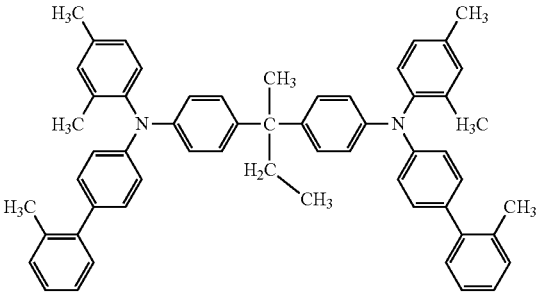
(CTM33)
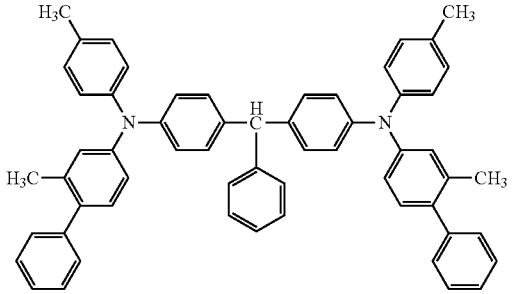
(CTM34)
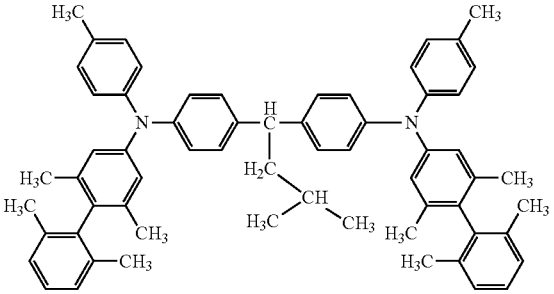
(CTM35)
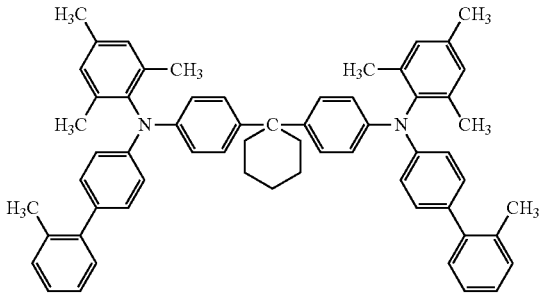
(CTM36)
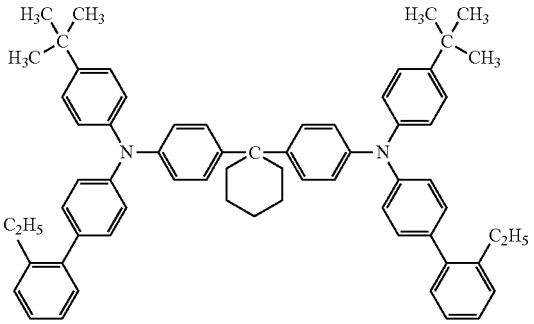
(CTM37)
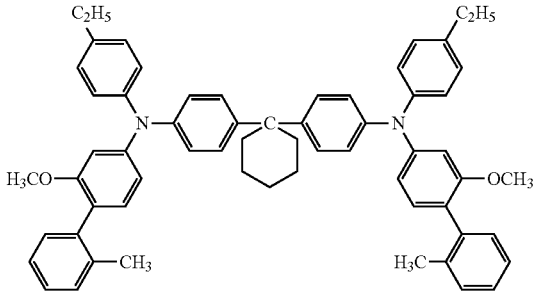
(CTM38)
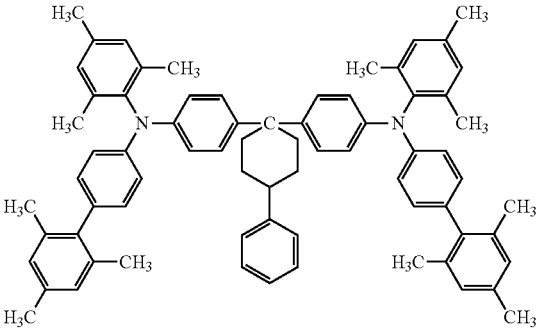

-continued
(CTM39)
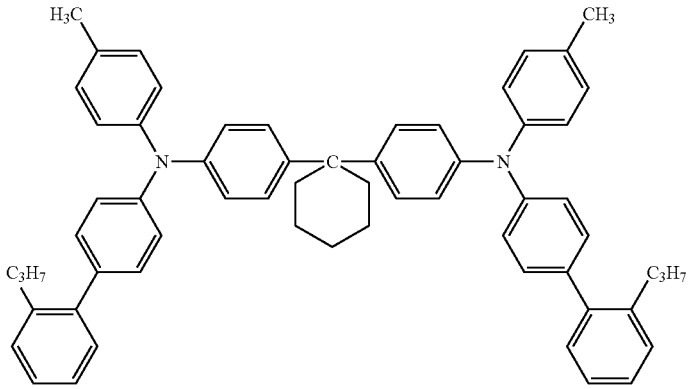
(CTM40)
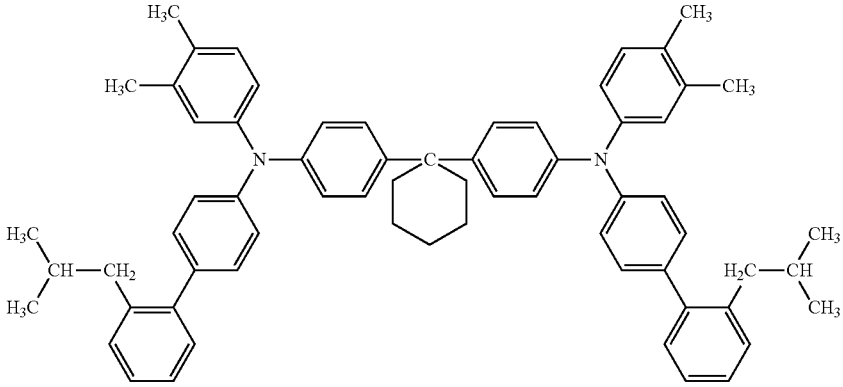
(CTM41)
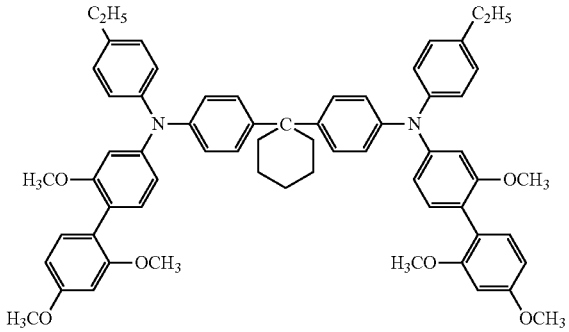
(CTM42)
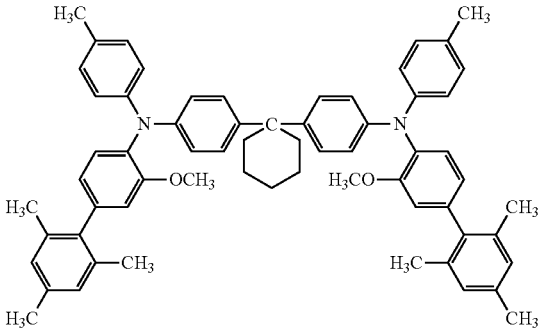
(CTM43)
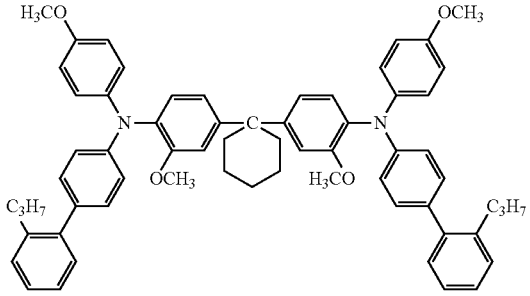
(CTM44)
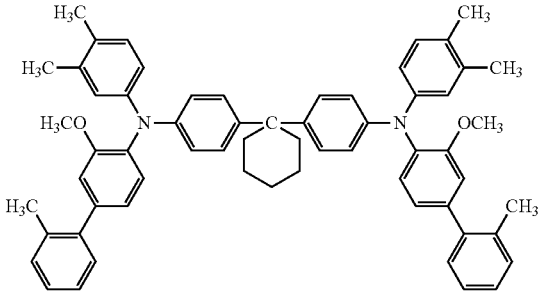

-continued (CTM45)

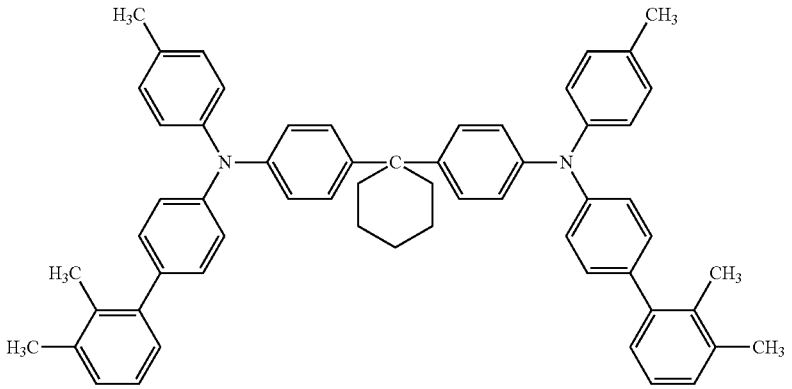

In order to synthesize the compound represented by Formula (2), a triphenylamine which has a biphenyl group may be reacted with various ketones using an acid as catalyst. It can also be synthesized via a variety of methods using a diamino compound represented by Formula (3) and an aryl halide.

Formula (3)

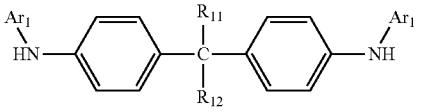

In Formula (3), $Ar_1$ represents a phenyl group which may have a substituent, or the biphenyl group which has a substituent in Formula (1), and $R_{11}$ and $R_{12}$ are the same as $R_9$ and $R_{10}$ in Formula (2).

Other than the aforementioned compounds, well known hole transport type (P type) charge transport material (CTM) may be used and these compounds may be used in combination, however, it is preferable that the compound represented by above Formula (1) or (2) is used as a main charge transport material.

Specific examples of a constitution of the electrophotographic photoreceptor according to the present invention will be shown below:

1) A layer arrangement of a conductive support having thereon a charge generation layer and a charge transport layer in the said sequence as photosensitive layers;

2) A layer arrangement of a conductive support having thereon a charge generation layer, a first charge transport layer and a second charge transport layer in the said sequence as photosensitive layers;

3) A layer arrangement of a conductive support having thereon a single layer containing a charge generation material and a charge transport material as a photosensitive layer;

4) A layer arrangement of a conductive support having thereon a charge transport layer and a charge generation layer in the said sequence as photosensitive layers;

5) A layer arrangement having a surface protective layer over a layer arrangement of any one of above 1)-4).

The photoreceptor of the present invention may have any one of the foregoing layer arrangements.

Above layer arrangements 1)-4) containing a charge generation layer containing a charge generation material and a charge transport layer containing a charge transport material are preferable embodiments of the present invention. In the present invention, a layer arrangement of above 2) is most preferably employed.

The electrophotographic photoreceptor of the present invention preferably has an intermediate layer (or a subbing layer) formed on the conductive support before providing a photosensitive layer irrespective of the above layer arrangements.

Next, the layer arrangement of the electrophotographic photoreceptor will be described focusing on the layer arrangement of above 2).

Electrically Conductive Support

Any of an electrically conductive support in the form of a sheet and a cylindrical conductive support, which is used for a photoreceptor, may be employed, but in order to compactly design an image forming apparatus, the cylindrical conductive support is preferable.

The cylindrical conductive support means a cylindrical support to endlessly form images via rotation, and the conductive support having a straightness of 0.1 mm or less and a swing width of 0.1 mm or less is preferable. When the straightness and the swing width exceed the above-described ranges, good images are difficult to be formed.

As to the conductive material, a metal drum made of aluminum, nickel or the like, a plastic drum on which aluminum, tin oxide, indium oxide or the like is evaporated, and a paper or plastic drum on which a conductive material is coated are usable. The conductive support preferably has a specific resistance of $10^3$ Ωcm or less at room temperature. The conductive support of the present invention is most preferably an aluminum support. The aluminum support in which a component of manganese, zinc, magnesium or the like in addition to aluminum as a principal component is mixed is utilized. Intermediate layer In the present invention, an intermediate layer is preferably formed between the conductive support and a photosensitive layer.

In the intermediate layer used in the present invention preferably contains metal oxide particles. Specifically, N-type semiconductor particles exhibiting N-type property are preferably contained. The N-type semiconductor particles refer to particles exhibiting the property of the main charge carrier being electrons. In other words, since the main charge carrier is electrons, the intermediate layer using N-type semiconductor particles exhibits properties of efficiently blocking hole-injection from the substrate and reduced blocking for electrons from the photosensitive layer.

Preferred metal oxide particles exhibiting an N-type semiconductor property preferably include titanium oxide ($TiO_2$) and zinc oxide (ZnO), of which the titanium oxide is specifically preferred.

Metal oxide particles employ those having a number average primary particle size of 3 to 200 nm, and preferably 5 to 100 nm. The number average primary particle size is a Feret-direction average diameter obtained in image analysis when N-type semiconductor particles are observed by a transmission electron microscope and 1,00 particles are randomly observed as primary particles from images magnified at a factor of 10000. In cases when the number average primary particle size of N-type semiconductor particles is less than 3.0 nm, it becomes difficult to disperse the N-type semiconductor particles in a binder constituting an intermediate layer and the particles are easily aggregated, so that the aggregated particles act as a charge trap, making it easy to cause a transfer memory.

When the number average primary particle size is more than 200 nm, N-type semiconductor particles cause unevenness on the intermediate layer surface, tendering to cause non-uniformity of dot images via such unevenness. Further, when the number average primary particle size is larger than 200 nm, N-type semiconductor particles easily precipitate in the dispersion, often causing deterioration of dot images.

Crystal forms of titanium oxide particles include, for example, an anatase type, a rutile type, a brookite type and an amorphous type. Of these, rutile type or anatase type titanium oxide particles effectively enhance rectification of a charge passing the intermediate layer. Thus, mobility of electrons is enhanced to stabilize the charge potential, and increase of residual potential is suppressed, contributing to high-density dot image formation, whereby most preferably used in the present invention.

Metal oxide particles are preferably those which were previously surface-treated with a polymer containing a methyl hydrogen siloxane unit. A polymers containing a methyl hydrogen siloxane unit and having a molecular weight of 1000 to 20000 effectuates enhanced surface treatment, resulting in enhanced rectifying capability of N-type semiconductor particles. Accordingly, the use of such metal oxide particles prevents occurrence of black spotting and is effective in optimal reproduction of dot images.

The polymer containing a methyl hydrogen siloxane unit is preferably a copolymer containing a structural unit of —[HSi($CH_3$)O]— and other structural unit (other siloxane units). Of other siloxane units, a dimethylsiloxane unit, a methylethylsiloxane unit, a methylphenylsiloxane unit or diethylsiloxane unit is preferred and a dimethylsiloxane unit is specifically preferred. The content of methyl hydrogen siloxane in a copolymer is preferably 10 to 99 mol % and more preferably 20 to 90 mol %.

A methyl hydrogen siloxane copolymer may be any one of a random copolymer, a block copolymer and a graft copolymer, but a random copolymer or a block copolymer is preferred. The copolymer may be comprised of a single component or two or more components in addition to methyl hydrogen siloxane.

Other than the foregoing metal oxide particles, a coating solution to form the intermediate layer used in the invention is composed of a binder resin, a dispersing solvent and the like.

The volume of metal oxide particles used in the intermediate layer is preferably 1.0 to 2.0 times that of the binder resin of the intermediate layer. Such a high density of metal oxide particles in the intermediate layer results in enhanced rectification and even when the layer thickness is increased, neither an increase of residual potential nor spotting occur and black spots are effectively prevented, thereby forming an electrophotographic photoreceptor exhibiting little potential variation and capable of forming superior halftone images. The intermediate layer contains metal oxide particles preferably in an amount of 100 to 200 parts by volume.

On the other hand, as a binder resin to disperse the metal oxide particles, and to form a layer structure of the intermediate layer, for example, a polyamide resin, an alkyd resin or a resol type phenol resin is preferable in order to obtain excellent dispersibility of the metal oxide particles. Of these, an alcohol-soluble polyamide resin is preferable as a polyamide resin. As a binder resin used for the intermediate layer in the electrophotographic photoreceptor, a resin exhibiting excellent solvent solubility is desired to form an intermediate layer having a uniform thickness. As such an alcohol-soluble polyamide resin, known is a copolymerized polyamide resin or a methoxy-methylated polyimide resin composed of a chemical structure having not so many carbon chains between amide bonds such as 6-nylon, but the following polyamides other than these may also be preferably used.

N-1

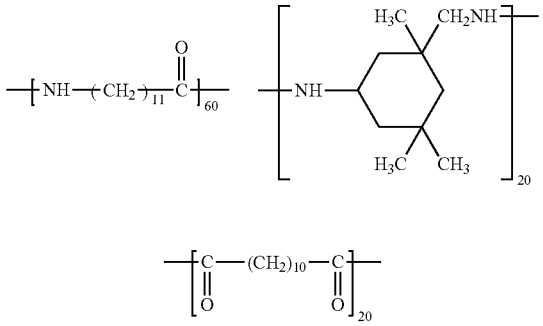

N-2

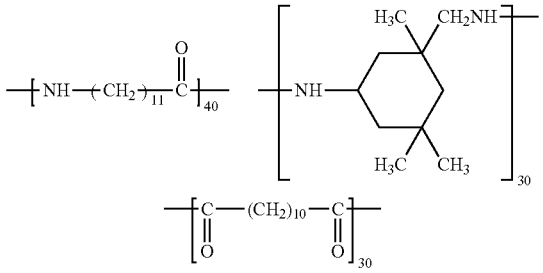

N-3

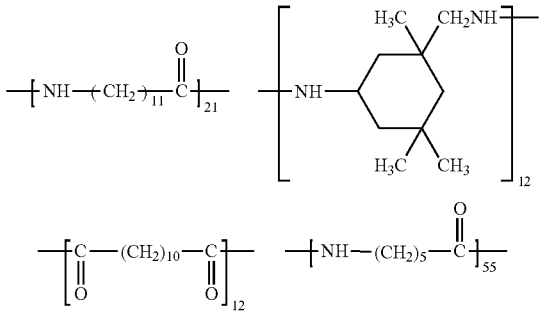

N-4

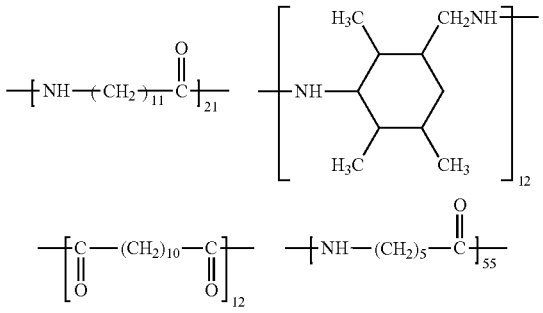

-continued

N-5

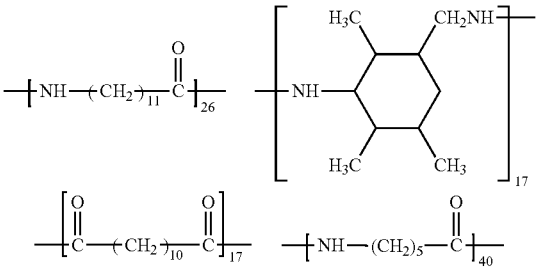

The component ratios the above polyamides N-1 through N-5 are represented by mol %.

Further, the above-described polyamide resin preferably has a number average molecular weight of 5,000-80,000, and more preferably has a number average molecular weight of 10,000-60,000. In the case of a number average molecular weight of 5,000 or less, evenness in thickness of the intermediate layer is degraded, whereby the effect of the present invention is not sufficiently produced. On the other hand, in the case of a number average molecular weight of at least 80,000, solvent solubility of a resin is degraded, and a coagulated resin is easy to be produced in the intermediate layer, whereby generation of black spots and degradation of dot images are easy to be produced.

A part of the above-described polyamide resin has been commercially available, for example, under the trade name of VESTAMELT X1010, X4685 or the like, produced by Daicel-Degussa Ltd. They can be prepared by a commonly known method of synthesizing polyamide, but one synthesizing example is described below.

As a solvent to dissolve the above-described polyamide resin to prepare a coating solution, alcohol having 2-4 carbon atoms such as ethanol, n-propyl alcohol, iso-propyl alcohol, n-butanol, t-butanol, sec-butanol or the like is preferable in view of solubility of polyamide and coatability of the coating solution. The solvent in the total solvent has a content of 30-100% by mass, preferably has a content of 40-100% by mass, and more preferably has a content of 50-100% by mass. Examples of the auxiliary solvent to produce a favorable effect in combination with the foregoing solvent include methanol, benzyl alcohol, toluene, methylene chloride, cyclohexanone, tetrahydrofiran and so forth.

The intermediate layer preferably has a thickness of 0.3-10 μm. When the intermediate layer has a thickness of less than 0.3 μm, deterioration of dot image tends to occur. When the intermediate layer has a thickness exceeding 10 μm, increase in residual potential is easy to be generated, whereby deterioration of dot image tends to occur. The intermediate layer more preferably has a thickness of 0.5-5 μm.

It is also preferable that the intermediate layer is substantially an insulating layer. Herein, the insulating layer means a layer having a volume resistance of at least $1\times10^{8}$ Ω·cm. The intermediate layer as well as the protective layer preferably has a volume resistance of $1\times10^{8}$-$1\times10^{15}$ Ω·cm, more preferably has a volume resistance of $1\times10^{9}$-$1\times10^{14}$ Ω·cm, and still more preferably has a volume resistance of $2\times10^{9}$-$1\times10^{13}$ Ω·cm. The volume resistance can be measured as described below.

The measurement conditions: in accordance with JIS: C2318-1975.

Measuring device: HIRESTA IP manufactured by Mitsubishi Chemical Corporation

Measuring probe: Measuring probe HRS

Applied voltage: 500 V

Measuring environment: 30±2° C., 80±5 RH %

In the case of a volume resistance of less than $1\times10^{8}$ Ω·cm, a charge blocking property of the intermediate layer is lowered, generation of black spots is increased, and a potential holding property of the photoreceptor is deteriorated, whereby no good image quality can be obtained. On the other hand, in the case of a volume resistance exceeding $1\times10^{15}$ Ω·cm, the residual potential tends to be increased in repetitive image formation, whereby no good image quality can be obtained.

(Photosensitive Layer)

In the photoreceptor of the present invention, a single layer structure, namely, a layer having both a charge generation function and a charge transport function is provided on an intermediate layer, may be employed, however, more preferably, the function of a photosensitive layer is separated to a charge generation layer (CGL) and a charge transfer layer (CTL).

Thus separated constitution can restrain an increase of residual potential along with repeated use and can easily control other electrophotographic characters according to the object. In a negatively charged photoreceptor, it is preferred that a charge generation layer (CGL) is formed on an intermediate later and further thereon a charge transport layer (CTL) is formed.

The layer arrangement of a separated function-negatively charging photoreceptor will be described below.

(Charge Generation Layer)

In the charge generation layer of the present invention, a titanyl phthalocyanine pigment having aforementioned X-ray diffraction spectrum characteristics is used as a charge generation material (CGM). However, other material, for example, a perylene compound such as an azo pigment or a perylene pigment, or a polycyclic quinone pigment may be used in combination.

A binder is preferably used as a dispersing medium of CGM in a charge generation layer. A commonly known resin is usable as the binder, but examples of the most preferable resin include a formal resin, a butyral resin, a silicone resin, a silicone-modified butyral resin and a phenoxy resin.

The ratio of the charge generation material to the resin binder is preferably 20-600 parts by mass, and more preferably 50-400 parts by mass, based on 100 parts by mass of the binder resin. The increase in residual potential caused by repetitive use can be minimized by using such a resin. The charge generation layer preferably has a thickness of 0.3-2 μm.

(Charge Transport Layer)

In the present invention, the charge transport layer may be a single layer or may be composed of a plurality of charge transport layers. When the charge transport layer is composed of a plurality of charge transport layers, preferable is a constitution in which the uppermost charge transport layer preferably contains inorganic particles.

The charge transport layer contains a charge transport material (CTM) and a binder resin which disperses the CTM and forms a layer. Additives such as the foregoing inorganic particles or an antioxidant forth may be optionally contained as other substances.

Examples of a charge transfer material (CTM) include the compounds represented by Formula (1) and (2) of the present invention.

These charge transport materials are usually dissolved in an appropriate binder resin to form a layer.

The binder resin usable in charge transport layer (CTL) may be any of a thermoplastic resin and a thermosetting resin. Examples thereof include resins such as a polystyrene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, and a copolymer resin having at least two of repeating unit structures of the above-described resins. Further, a polymer organic semiconductor such as poly-N-vinyl carbazole or the like other than these insulating resins is cited. Of these resins, most preferable is a polycarbonate resin exhibiting low water absorption, excellent dispersibility of CTM, and excellent electrophotographic properties.

The ratio of the charge transport material to the binder is preferably 50-200 parts by mass, and more preferably 100-200 parts by mass, based on 100 parts by mass of the binder resin.

The charge transport layer preferably has a total thickness of 10-25 μm. Further, the thickness of the charge transport layer which forms a surface layer is preferably 1.0-8.0 μm.

Examples of the solvent or the dispersing medium usable for forming an intermediate layer, a charge generation layer, a charge transport layer and so forth include n-butylamine, diethylamine, ethylenediamine, isopropanolamine, triethanolamine, triethylene diamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide, methyl cellosolve, and so forth. The present invention is not limited thereto, but environmental conscious solvents such as tetrahydrofuran, methyl ethyl ketone and so forth are preferably used. These solvents may also be used singly or in combination with at least two kinds of mixed solvents.

Next, as coating methods to prepare a photoreceptor, an immersion coating method, a spray coating method and so forth, in addition to a slide hopper type coating method, are used. For the formation of a surface layer, most preferable is a slide hopper type coating method.

Of coating solution-supplying type coaters, a coating method using a slide hopper type coater is most suitable for use of a coating solution of a low-boiling point solvent dispersion. Coating by a circular slide hopper type coater as described in detail in JP-A 58-189061 is preferred for a cylindrical photoreceptor.

In the coating method employing a circular slide hopper type coater, the end of the slide surface and the substrate are disposed at a gap (approximately from 2 μm to 2 mm) so that coating is performed without damaging the substrate, where even in the case of multiple layer formation differing in kinds of layers, coating is feasible without damaging the coated layer. Further, even in multiple layer formation differing in the nature of layers but soluble in an identical solvent, residence time in the solvent is much shorter than a dip-coating method so that coating is performed without eluting a lower layer component into an upper layer or to a coating bath, whereby the dispersibility of the inorganic particles is not deteriorated.

The photoreceptor of the present invention preferably contains an antioxidant in its surface layer in order to prevent image-blurring. The surface layer is easily oxidized by an active gas such as $NO_x$ or ozone produced when electrostatically charging the photoreceptor, whereby image-blurring tends to occur. However, such image-blurring can be prevented by co-existing an antioxidant.

Such an antioxidant is a substance which exhibits a property of preventing or inhibiting the adverse action of oxygen under conditions such as light, heat or discharge with respect to an auto-oxidative material typically existing in the interior or on the surface of the photoreceptor.

Next, the image formation apparatus using the electrophotographic photoreceptor according to present invention will be described.

Image forming apparatus 1 shown in FIG. 1 is a digital image forming apparatus. It possesses image reading section A, image processing section B, image forming section C, and transfer paper conveyance section D as a transfer paper conveyance device.

An automatic document feeding device for automatically feeding documents is arranged on the top of image reading section A. The documents placed on document platen 11 as conveyed sheet by sheet employing document conveying roller 12, and the image is read at reading position 13*a*. The document having been read is ejected onto document ejection tray 14 by document conveying roller 12.

In the meantime, the image of the document placed on plate glass 13 is read by reading operation at speed v by first mirror unit 15 having an illumination lamp constituting a scanning optical system and a first mirror, and by the movement of second mirror unit 16 having the second and third mirrors located at the V-shaped position at speed v/2 in the same direction.

The scanned images are formed on the light receiving surface of image-capturing device (CCD) as a line sensor through projection lens 17. The linear optical images formed on image-capturing device (CCD) are sequentially subjected to photoelectric conversion into electric signals (luminance signals). Then they are subjected to analog-to-digital conversion, and then to such processing as density conversion and filtering in image processing section B. After that, image data is stored in the memory.

Image forming section C as an image forming unit possesses drum-formed photoreceptor 21 as an image carrier; charging device (charging process) 22 for charging photoreceptor 21 on the outer periphery; potential detecting device 220 for detecting the potential on the surface of the charged photoreceptor; developing device (developing process) 23; transfer conveyance belt apparatus 45 as a transfer section (transfer process); cleaning device (cleaning process) 26 for photoreceptor 21; and PCL (pre-charge lamp) 27 as an optical discharging section (optical discharging process). These components are arranged in the order of operations. Further, reflected density detecting section 222 for measuring the reflected density of the patch image developed on photoreceptor 21 is provided downstream from developing device 23. A photoreceptor of the present invention is used as photoreceptor 21, and is driven in the clockwise direction as illustrated.

Rotating photoreceptor 21 is electrically charged uniformly by charging device 22. After that, image exposure is performed based on the image signal called up from the memory of image processing section B by the exposure optical system as image exposure section (image exposure process) 30. In the exposure optical system as image exposure section 30 (also known as writing section), the optical path is bent by reflection mirror 32 through rotating polygon mirror 31, fθ lens 34, and cylindrical lens 35, using the laser diode (not illustrated) as a light emitting source, whereby main scanning is performed. Exposure is carried out at position Ao with reference to photoreceptor 21, and an electrostatic latent image is formed by the rotation (sub-scanning) of photoreceptor 21.

In the image forming apparatus of the present invention, when an electrostatic latent image is formed on the photoreceptor, a semiconductor laser or a light emitting diode having an oscillation wavelength of 350-500 nm is used as an imagewise exposure light source. Using such an imagewise exposure light source, digital exposure is carried out on the electrophotographic photoreceptor while narrowing a light exposure dot diameter in the writing main scanning direction within the range of 10-50 μm, whereby a high resolution electrophotographic image of 600-2500 dpi (dpi representing the number of dots per 2.54 cm) can be obtained.

The foregoing exposure light dot diameter means a length of the exposure beam along with the main scanning direction in the area where the intensity of this exposure beam corresponds to $1/e^2$ of the peak light intensity (Ld: measured at the maximum length position).

The light beam to be used includes the beams of the scanning optical system using the semiconductor laser, solid scanner such as an LED and so forth. The distribution of the light intensity includes Gauss distribution and Lorenz distribution. The portion exceeding $1/e^2$ of each peak intensity is assumed as an exposure light dot diameter of the present invention.

In the image forming apparatus according to the present invention, a developing means which develops an electrostatic latent image to a toner image is provided. The electrostatic latent image on photoreceptor 21 is subject to reverse development by developing device 23, and a visible toner image is formed on the surface of photoreceptor 21.

According to the image forming method of the present invention, polymerized toner is preferably utilized as the developer for this developing device. An electrophotographic image exhibiting excellent sharpness can be achieved when the polymerized toner having a uniform shape and particle size is used in combination with the photoreceptor of the present invention.

In transfer paper conveyance section D, sheet feed units 41(A), 41(B) and 41(C) as a transfer sheet storage device are arranged below the image forming unit, in which different sizes of transfer sheets P are stored. A manual sheet feed unit 42 for manual feed of the sheets of paper is provided on the side. Transfer sheets P selected one of the sheet feed units is fed along sheet conveyance path 40 by guide roller 43, and are temporarily suspended by sheet feed registration roller 44 for correcting the inclination and deviation of transfer sheets P. Then transfer sheet P is again fed and guided by sheet conveyance path 40, pre-transfer roller 43*a*, paper feed path 46 and entry guide plate 47. The toner image on photoreceptor 21 is transferred to transfer sheet P at transfer position Ba by transfer pole 24 and separator pole 25, while transfer sheet P is placed on and conveyed by transfer conveyance belt 454 of transfer conveyance belt apparatus 45. Then, transfer sheet P is separated from photoreceptor surface 21 and conveyed to fixing device 50 by transfer conveyance belt apparatus 45.

Fixing device 50 is equipped with fixing roller 51 and pressure roller 52. When transfer sheet P passes between fixing roller 51 and pressure roller 52, toner is fixed in position by heat and pressure. With the toner image having been fixed thereon, transfer sheet P is ejected onto ejection tray 64.

The above description indicates the case where an image is formed on one side of the transfer sheet. In the case of duplex copying, paper sheet ejection switching member 170 is switched and transfer sheet guide 177 is opened. Transfer sheet P is fed in the direction of an arrow shown in a broken line.

Further, transfer sheet P is fed downward by conveyance device 178 and is switched back by sheet reversing section 179. With the trailing edge of transfer sheet P becoming the leading edge, transfer sheet P is conveyed into sheet feed unit 130 for duplex copying.

Conveyance guide 131 provided on sheet feed unit 130 for duplex copying is moved in the direction of sheet feed by transfer sheet P. Then transfer sheet P is fed again by sheet feed roller 132 and is led to sheet conveyance path 40.

As described above, transfer sheet P is fed in the direction of photoreceptor 21 again, and the toner image is transferred on the reverse side of transfer sheet P. After the image has been fixed by fixing section 50, transfer sheet P is ejected to ejection tray 64.

The image forming apparatus of the present invention can be configured in such a way that the components such as the foregoing photoreceptor, developing device, cleaning device and so forth are integrally combined to a process cartridge, and this unit may be installed in the apparatus main body as a removable unit. It is also possible to arrange such a configuration that at least one of the charging device, the image exposure device, the developing device, the transfer or separation electrode and the cleaning device is unified in a body with the photoreceptor to form a process cartridge as a single removable unit capable of being installed in the apparatus main body, employing a guide device such as a rail of the apparatus main body.

Figure 2:
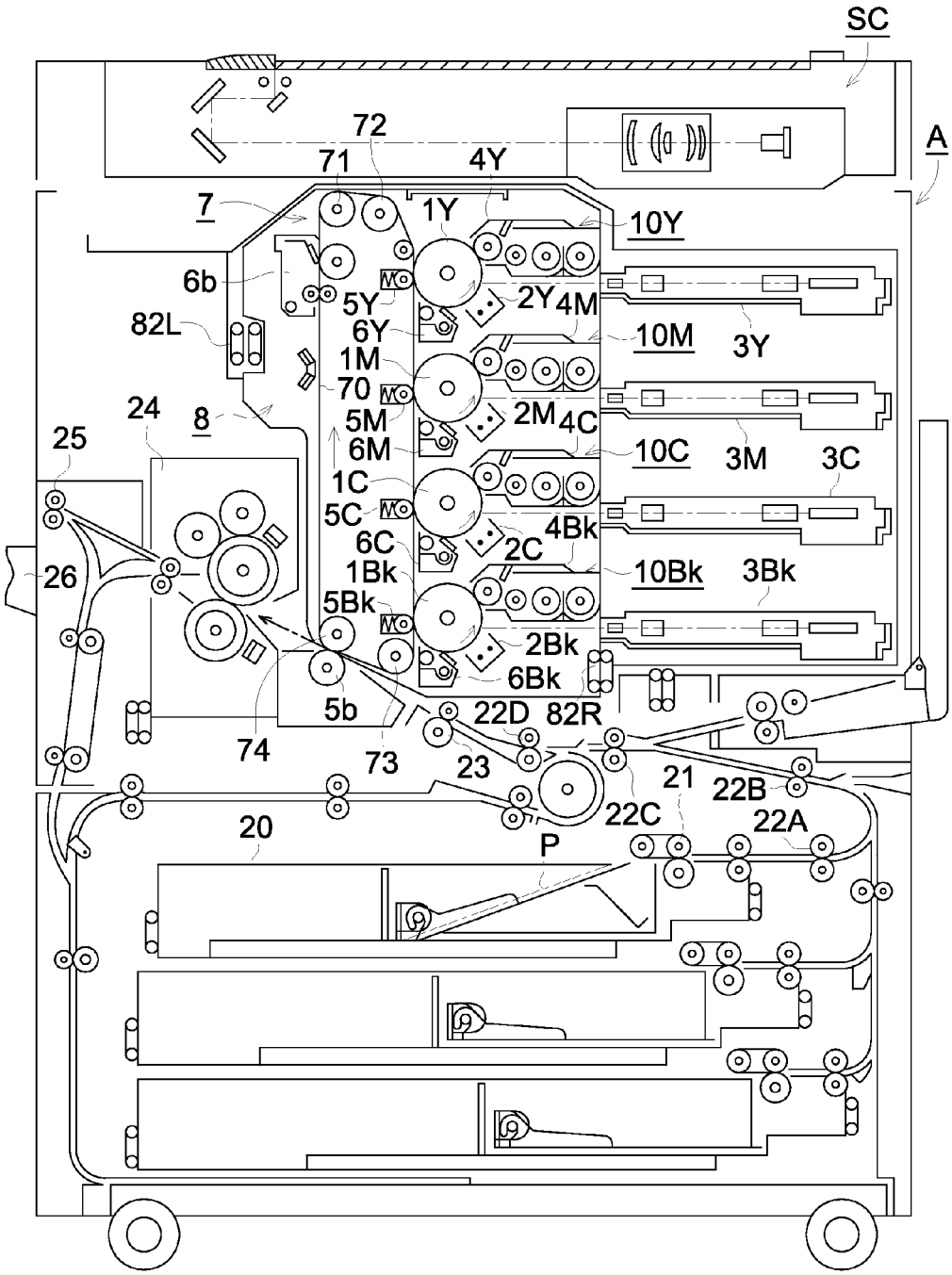
FIG. 2 shows a schematic cross-sectional diagram of a color image forming apparatus as one embodiment of the present invention.

FIG. 2 is a cross-sectional schematic diagram showing a color image forming apparatus as an embodiment of the present invention.

This color image forming apparatus is called the so-called tandem type color image forming apparatus, and comprises four sets of image forming sections (image forming units) 10Y, 10M, 10C, and 10Bk, endless belt shaped intermediate transfer member unit 7, sheet feeding and conveyance device 21, and fixing device 24. The original document reading apparatus SC is placed on top of main unit A of the image forming apparatus.

Image forming section 10Y that forms images of yellow color comprises charging device (charging process) 2Y, exposure device (exposure process) 3Y, developing device (developing process) 4Y, primary transfer roller 5Y as primary transfer section (primary transfer process), and cleaning device 6Y all placed around drum-formed photoreceptor 1Y which acts as the first image supporting body. Image forming section 10M that forms images of magenta color comprises drum-formed photoreceptor 1M which acts as the first image supporting body, charging device 2M, exposure device 3M, developing device 4M, primary transfer roller 5M as a primary transfer section, and cleaning device 6M. Image forming section 10C that forms images of cyan color comprises drum-formed photoreceptor 1C which acts as the first image supporting body, charging device 2C, exposure device 3C, developing device 4C, primary transfer roller 5C as a primary transfer section, and cleaning device 6C. Image forming section 10Bk that forms images of black color comprises drum-formed photoreceptor 1 Bk which acts as the first image supporting body, charging device 2Bk, exposure device 3Bk, developing device 4Bk, primary transfer roller 5Bk as a primary transfer section, and cleaning device 6Bk.

Four sets of image forming units 10Y, 10M, 10C, and 10Bk are constituted, centering on photoreceptor drums 1Y, 1M, 1C, and 1Bk, by rotating charging devices 2Y, 2M, 2C, and 2Bk, exposure devices 3Y, 3M, 3C, and 3Bk, rotating developing devices 4Y, 4M, 4C, and 4Bk, and cleaning devices 5Y, 5M, 5C, and 5Bk that clean photoreceptor drums 1Y, 1M, 1C, and 1Bk.

Image forming units 10Y, 10M, 10C, and 10Bk, all have the same configuration excepting that the color of the toner image formed in each unit is different on respective photoreceptor drums 1Y, 1M, 1C, and 1Bk, and detailed description is given below taking the example of image forming unit 10Y.

Image forming unit 10Y has, placed around photoreceptor drum 1Y which is the image forming body, charging device 2Y (hereinafter referred to merely as charging unit 2Y or charger 2Y), exposure device 3Y, developing device 4Y, and cleaning device 5Y (hereinafter referred to simply as cleaning device 5Y or as cleaning blade 5Y), and forms yellow (Y) colored toner image on photoreceptor drum 1Y. Further, in the present preferred embodiment, at least photoreceptor drum 1Y, charging device 2Y, developing device 4Y, and cleaning device 5Y in image forming unit 10Y are provided in an integral manner.

Charging device 2Y is a device that applies a uniform electrostatic potential to photoreceptor drum 1Y, and corona discharge type charger unit 2Y is being used for photoreceptor drum 1Y in the present preferred embodiment.

Image exposure device 3Y is a device that conducts light exposure, based on an image signal (Yellow), and forms an electrostatic latent image corresponding to the yellow color image. Exposure device 3Y is one composed of LED arranged in the form of an array in the direction of photoreceptor drum 1Y axis, and an image focusing element (product name: Selfoc lens), or is a laser optical system.

The image forming apparatus of the present invention can be configured in such a way that the constituents such as the foregoing photoreceptor, a developing device, a cleaning device and so forth are integrally combined to a process cartridge (image forming unit), and this image forming unit may be installed in the apparatus main body as a removable unit. It is also possible to arrange such a configuration that at least one of the charging device, the image exposure device, the developing device, the transfer or separation device and the cleaning device is integrally supported with the photoreceptor to form a process cartridge (image forming unit) as a single removable image forming unit, employing a guide device such as a rail of the apparatus main body.

Intermediate transfer member unit 7 in the form of an endless belt is wound around a plurality of rollers, and has endless belt shaped intermediate transfer member 70 which acts as a second image carrier in the shape of a partially conducting endless belt which is supported in a free manner to rotate.

The images of different colors fanned by image fanning units 10Y, 10M, 10C, and 10Bk, are successively transferred on to rotating endless belt shaped intermediate transfer member 70 by primary transfer rollers 5Y, 5M, 5C, and 5Bk acting as the primary image transfer section, thereby forming the synthesized color image. Transfer material P as the transfer material stored inside sheet feeding cassette 20 (the supporting body that carries the final fixed image: for example, plain paper, transparent sheet, etc.) is fed from sheet feeding device 21, pass through a plurality of intermediate rollers 22A, 22B, 22C, and 22D, and resist roller 23, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing device 24, and is gripped by sheet discharge rollers 25 and placed above sheet discharge tray 26 outside the equipment. Here, the transfer supporting body of the toner image formed on the photoreceptor of the intermediate transfer body or of the transfer material, etc. is comprehensively called the transfer medium.

On the other hand, after the color image is transferred to transfer material P by secondary transfer roller 5*b* functioning as the secondary transfer section, endless belt shaped intermediate transfer member 70 from which transfer material P has been separated due to different radii of curvature is cleaned by During image forming, primary transfer roller 5Bk is at all times contacting against photoreceptor 1Bk. Other primary transfer rollers 5Y, 5M, and 5C come into contact respectively with corresponding photoreceptors 1Y, 1M, and 1C only during color image forming.

Secondary transfer roller 5*b* comes into contact with endless belt shaped intermediate transfer body 70 only when secondary transfer is conducted with transfer material P passing through this.

Further, chassis 8 can be pulled out via supporting rails 82L and 82R from body A of the apparatus.

Chassis 8 possesses image forming sections 10Y, 10M, 10C, and 10Bk, and endless belt shaped intermediate transfer member unit 7.

Image forming sections 10Y, 10M, 10C, and 10Bk are arranged in column in the vertical direction. Endless belt shaped intermediate transfer member unit 7 is placed to the left side in the figure of photoreceptor drums 1Y, 1M, 1C, and 1Bk. Endless belt shaped intermediate transfer member unit 70 possesses endless belt shaped intermediate transfer member 70 that can rotate around rollers 71, 72, 73, and 74, primary image transfer rollers 5Y, 5M, 5C, and 5Bk, and cleaning device 6

Figure 3:
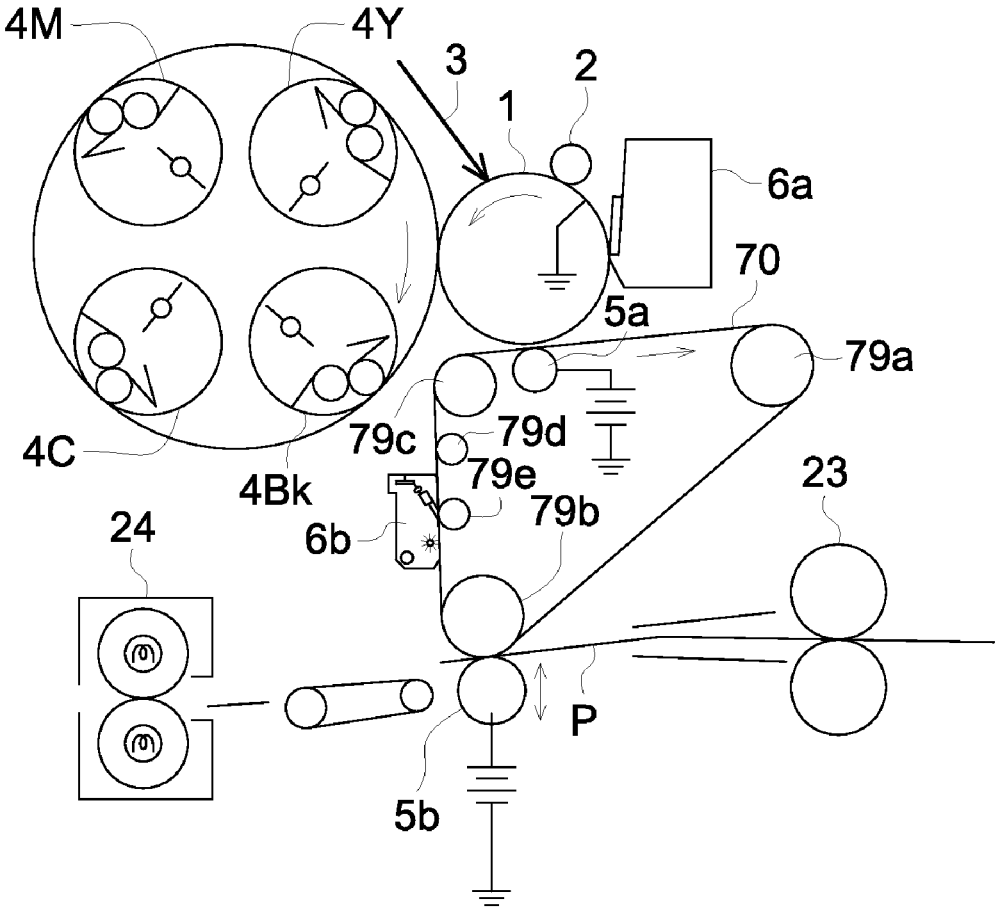
FIG. 3 shows a schematic cross-sectional diagram of color image forming apparatus fitted with an electrophotographic photoreceptor of the present invention.

Next, FIG. 3 shows a cross-sectional configuration diagram of a color image forming apparatus fitted with an electrophotographic photoreceptor of the present invention (a copier or a laser beam printer possessing at least a charging device, an exposure device, a plurality of developing devices, an image transfer device, a cleaning device, and an intermediate transfer member provided around the electrophotographic photoreceptor). An elastic body with a medium level of electrical resistivity is employed for belt shaped intermediate transfer member 70.

Numeral 1 represents a rotating drum type photoreceptor that is repetitively used as the image carrying body, and is driven to rotate with a specific circumferential velocity in the anti-clockwise direction indicated by the arrow.

During rotation, photoreceptor 1 is evenly charged to a specific polarity and potential by charging device (charging process) 2, and next, when it receives image exposure obtained via scanning exposure light with a laser beam modulated in accordance with the time-serial electrical digital pixel signal of the image information from image exposure device (image exposure process) 3 not shown in the figure, formed is an electrostatic latent image corresponding to yellow (Y) color component image (color information) as an intended color image.

Next, the electrostatic latent image is developed by yellow (Y) developing device: developing process (yellow color developing device) 4Y employing the yellow toner as the first color. In this case, the second developing device to the fourth developing device (magenta color developing device, cyan color developing device, and black color developing device) 4M, 4C, and 4Bk each are in the operation switched-off state and do not act on photoreceptor 1, and the yellow toner image of the above-described first color does not get affected by the above-described second developing device to fourth developing device.

Intermediate transfer member 70 is passed through rollers 79*a*, 79*b*, 79*c*, 79*d*, and 79*e* and is driven to rotate in a clockwise direction with the same circumferential speed as photoreceptor 1.

The yellow toner image of the first color formed and retained on photoreceptor 1 is, in the process of passing through the nip section between photoreceptor 1 and intermediate transfer member 70, intermediate-transferred (primary transferred) successively to the outer peripheral surface of intermediate transfer member 70 due to the electric field formed by the primary transfer bias voltage applied from primary transfer roller 5*a* to intermediate transfer member 70.

The surface of photoreceptor 1 after it has completed the transfer of the first color yellow toner image to intermediate transfer member 70 is cleaned by cleaning device 6*a*.

In the same manner as described above, the second color magenta toner image, the third color cyan toner image, and the fourth color black toner image are transferred successively on to intermediate transfer member 70 in a superimposing manner, thereby forming the superimposed color toner image corresponding to the intended color image.

Secondary transfer roller 5*b* is placed so that it is supported by bearings parallel to secondary transfer opposing roller 79*b* and pushes against intermediate transfer member 70 from below in a separable condition.

In order to carry out successive overlapping transfer of the toner images of the first to fourth colors from photoreceptor 1 to intermediate transfer member 70, the primary transfer bias voltage applied has a polarity opposite to that of the toner and is applied from the bias power supply. This applied voltage is, for example, in the range of +100 V to +2 kV.

During the primary transfer process of transferring the first to the third color toner image from photoreceptor 1 to intermediate transfer member 70, secondary transfer roller 5*b* and intermediate transfer member cleaning device 6*b* can be separated from intermediate transfer member 70.

The transfer of the superimposed color toner image transferred onto belt shaped intermediate transfer member 70 on to transfer material P which is the second image supporting body is done when secondary transfer roller 5*b* is in contact with the belt of intermediate transfer member 70, and transfer material P is fed from corresponding sheet feeding resist roller 23 via the transfer sheet guide to the contacting nip between secondary transfer roller 5*b* and intermediate transfer member 70 at a specific timing. The secondary transfer bias voltage is applied from the bias power supply to secondary image transfer roller 5*b*. Because of this secondary transfer bias voltage, the superimposed color toner image is transferred (secondary transfer) from intermediate transfer member 70 to transfer material P which is the second image supporting body. Transfer material P which has received the transfer of the toner image is guided to fixing device 24 and is heated and fixed there.

The image forming apparatus of the present invention is commonly suitable for electrophotographic apparatuses such as electrophotographic copiers, laser printers, LED printers, liquid crystal shutter type printers and so forth. Further, the image forming apparatus can be widely utilized for apparatuses for displaying, recording, light printing, plate making and facsimile applied from an electrophotographic technique.

EXAMPLES

The present invention will be described in detail using examples, however, the present invention is not limited thereto. "Part" as used in the present EXAMPLES represents "part by mass" unless otherwise specified.

[Synthesis of Titanyl Phthalocyanine]

The titanyl phthalocyanine pigment exhibiting the X-ray diffraction spectral characteristics according to the present of the invention can be synthesized by a synthesis method disclosed in JP-A No. 2006-276829.

Synthetic Example 1

To a mixture of 29.2 parts of 1,3-diiminoisoindrine and 200 parts of sulfolanes, 20.4 parts of titanium-tetra-butoxide was added in drops. After the dropping was finished, the temperature was gradually raised to 180° C., and the mixture was stirred for 5 hours to react while the temperature was kept at 170-180° C. After the reaction was finished, the product was left for cooling and the deposited substance was separated by filtration. The separated substance was washed by chloroform until the powder becomes blue, subsequently washed with methanol several times, further washed with hot water of 80° C. several times and then dried, whereby crude tinanyl phthalocyanine was obtained. The obtained crude titanyl phthalocyanine was dissolved in 20 times of concentrated sulfuric acid. Then, the solution was added in drops into 100 times of ice water, and deposited crystal was separated by filtration. The crystal was repeatedly washed with ion-exchanged water (pH: 7.0, specific conductance: 1.0 μS/cm) until the washing water exhibited neutrality, whereby a wet cake (water paste) of titanyl phthalocyanine was obtained. The ion-exchanged water after used for washing showed a pH value of 6.8 and a specific conductance of 2.6 μS/cm. Forty parts of the obtained wet cake (water paste) was poured in 200 parts of tetrahydrofuran, stirred for 4 hours, filtered and then dried to obtain titanyl phthalocyanine powder which was designated as pigment 1.

The solids content of the above wet cake was 15 wt %. Accordingly, the mass ratio of the crystal transformation solvent to the wet cake was 33 times. Herein, the raw materials of pigment 1 contained no halide.

The measurement of X-ray diffraction spectrum of the obtained titanyl phthalocyanine powder carried out under the conditions listed below showed the following Bragg angles 2θ (±0.2°) of X-ray diffraction employing a characteristic X-ray of a CuKα radiation (having a wavelength of 1.542 Å):

a largest diffraction peak at 27.2±0.2°, a diffraction peak of a lowest angle at 7.3±0.2° and major diffraction peaks at 9.4±0.2°, 9.6±0.2° and 24.0±0.2° while exhibiting no peak between the peaks of 7.3±0.2° and 9.4±0.2° and no peak at 26.3±0.2°.

Figure 4:
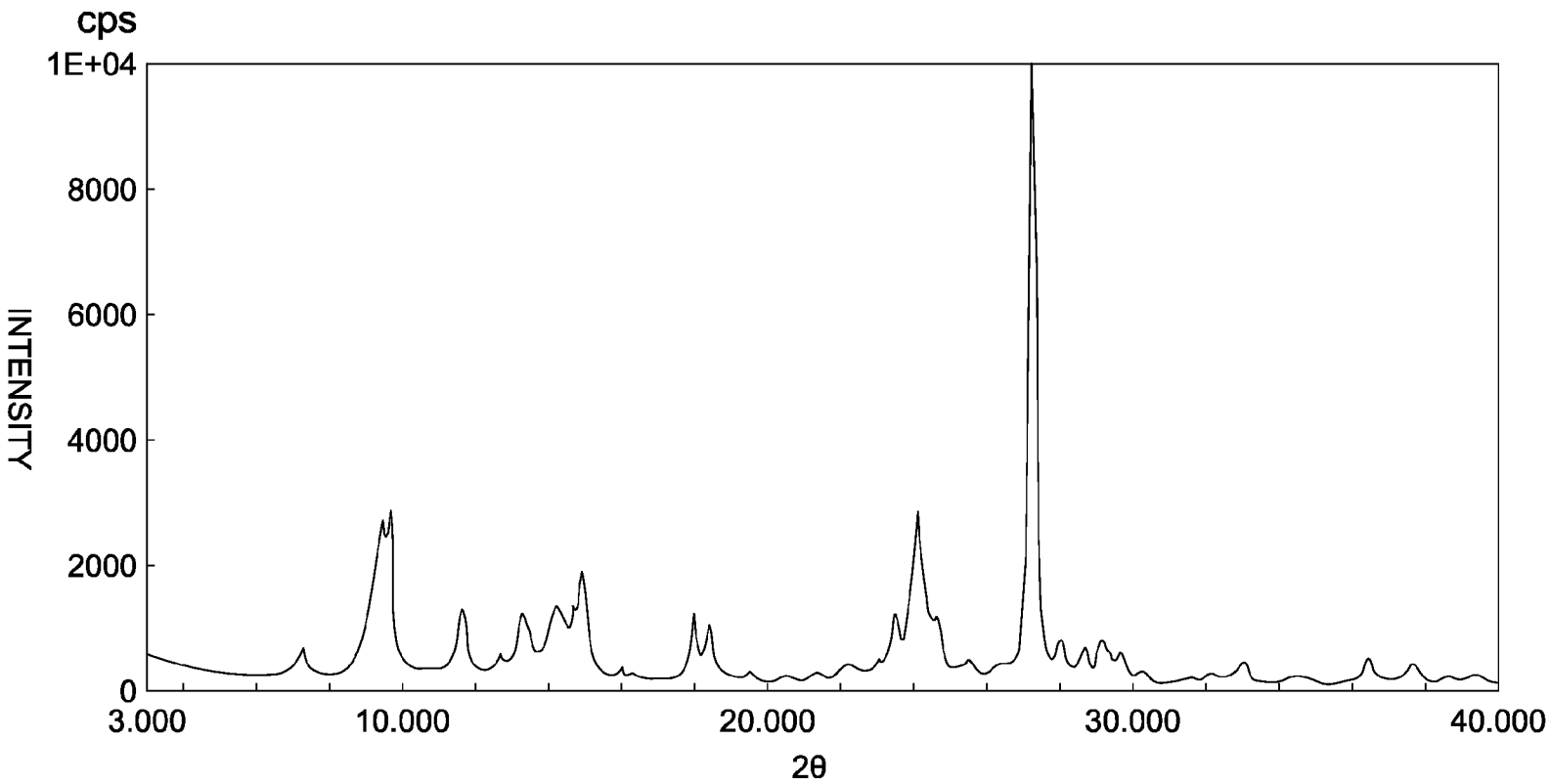
FIG. 4 shows an X-ray diffraction spectrum of Pigment 1 (titanyl phthalocyanine powder).

The X-ray diffraction spectrum of pigment 1 will be shown in FIG. 4.

(X-Ray Diffraction Spectrum Measurement Condition)

X-ray tube: Cu
Voltage: 50 kV
Electric current: 30 mA
Scanning speed: 2°/min
Scanning range: 3°-40°
Time constant: 2 seconds

Synthetic Example 2

A water paste of the titanyl phthalocyanine pigment was obtained in the same manner as described for synthetic example 1, and crystal transformation was carried out as follows to obtain pigment 2.

Into 60 parts of the wet cake obtained in synthetic example 1 before crystal transformation, 400 parts of tetrahydrofiran was added and vigorously stirred using a homomixer MARK II model f produced by PRIMIX Corp. at 2000 rpm under ambient temperature. When the dark blue color of the paste turned to light blue (20 minutes after the stirring was started), the stirring was stopped, and immediately the product was subjected to filtration under reduced pressure. The crystal obtained on the filter was washed with tetrahydrofiran to obtain a wet cake of the pigment, which was then dried for 2 days under a reduced pressure of 665 Pa at 70° C., whereby 8.5 parts of titanyl phthalocyanine crystal was obtained. The obtained titanyl phthalocyanine crystal was designated as pigment 2. The raw materials of pigment 2 contained no halide. The solids content of the above wet cake (water paste) was 15 wt %. Accordingly, the mass ratio of the crystal transformation solvent to the wet cake was 44 times.

Synthetic Example 3

The crystal transformation was carried out in the same manner as described for synthetic example 2, except that the stirring was stopped at 30 minutes after the stirring was started. Thus, a titanyl phthalocyanine crystal was obtained, which was designated as pigment 3.

Synthetic Example 4

The crystal transformation was carried out in the same manner as described for synthetic example 2, except that the stirring was stopped at 40 minutes after the stirring was started. Thus, a titanyl phthalocyanine crystal was obtained, which was designated as pigment 4.

Synthetic Example 5

Comparative Synthetic Example

The wet cake produced in above synthetic example 1 was dried, and 1 part of the dried product was added to 50 parts of polyethylene glycol, followed by mixing in a sandmill together with 100 parts of glass bead. The product was dried to obtain a pigment, which was designated as pigment 5.

Synthetic Example 6

Comparative Synthetic Example

The wet cake produced in above synthetic example 1 was dried. One part of the dried product was stirred in a mixed solvent of 10 parts of ion-exchanged water and 1 part of monochlorobenzene for 1 hour at 50° C., followed by washing with methanol and ion-exchanged water. The product was dried to obtain a pigment, which was designated as pigment 6.

Synthetic Example 7

Comparative Synthetic Example

According to the method described for synthetic example 1 of JP-A No. 64-1728, a pigment was prepared. Namely, 5 parts of α type titanyl phthalocyanine was treated in a sand grinder at 100° C. for 10 hours together with 10 parts of sodium chloride and 5 parts of acetophenone, as a crystal formation treatment. The product was washed with ion-exchanged water and methanol, purified with diluted sulfuric acid, washed with ion-exchanged water until no acid component was left, and dried to obtain a pigment, which was designated as pigment 7. The raw materials of pigment 7 contains a halide.

Synthetic Example 8

Comparative Synthetic Example

According to the method described for symthetic example 2 of JP-A No. 3-255456, a pigment was prepared. Namely, 10 parts of the wet cake prepared in synthetic example 1 was mixed with 15 parts of sodium chloride and 7 parts of diethylene glycol and was subjected to a milling treatment at 80° C. for 60 hours in an automatic mortar. Subsequently, the product was thoroughly washed in order to completely remove the sodium chloride and diethylene glycol contained in the product. After the product was dried under a reduced pressure, 200 parts of cyclohexanon and glass bead of 1 mm in diameter were mixed and the mixture was treated in a sand mill for 30 minutes to obtain a pigment, which was designated as pigment 8. The raw materials of pigment 8 contains no halide.

Pigments 2-8 produced in above synthetic examples 2-8 each were subjected to a measurement of X-ray diffraction spectrum in the same manner as described above. The results of the X-ray diffractometry were shown in Table 1.

Preparation of Photoreceptor 1

Photoreceptor 1 was prepared as described below. The surface of a cylindrical aluminum support was subjected to a cutting work to prepare a conductive support having a 10 points surface roughness Rzjis of 0.5 μm.

<Intermediate Layer>

The following intermediate layer dispersion was diluted twice with the same mixed solvent, and filtered after still standing over night (filter; Rigimesh filter, produced by Pall Corporation with a nominal filtration accuracy of 5 μm and a pressure of 50 kPa) to prepare an intermediate layer coating solution.

(Preparation of Intermediate Layer Dispersion)

| | |
|---|---|
| Binder resin; (exemplified polyamide N-1) | 1.0 part |
| N-type semiconduction particles: Rutile-type titanium dioxide A1 (the primary particle diameter of 35 nm; surface treated with 5% by mass of a copolymer of methyl hydrogen siloxane and dimethyl siloxane (molar ratio 1:1) based on the total mass of titanium oxide) | 3.5 parts |
| Ethanol/n-propylalcohol/THF (=45/20/30 in mass ratio) | 10 parts |

The above-described components were mixed, and dispersed employing a sand mill homogenizer for 10 hours by a batch system, to prepare an intermediate layer dispersion.

The above intermediate layer coating solution was applied on the above conductive support by a dip coat method, followed by drying at 120° C. for 30 minutes to prepare an intermediate layer having a dry thickness of 3 μm.

<Charge Generation Layer: CGL>

| | |
|---|---|
| Charge generation material; a titanyl phthalocyanine pigment of synthetic example 1 | 24 parts |
| Polyvinyl butyral resin "S-LEC BL-1 produced by Sekisui Chemical Co., Ltd. | 12 parts |
| 2-butanone/cyclohexanone = 4/1 (v/v) | 300 parts |

The above-described compositions were mixed and dispersed employing a sand mill to prepare a charge generation layer coating solution. This coating solution was applied on the intermediate layer by a dip coat method to form a charge generation layer having a dry thickness of 0.5 μm.

<Charge Transport Layer (CTL)>

| | |
|---|---|
| Charge transport material(CTM): (CTM-45) | 225 parts |
| Polycarbonate (Z300, produced by Mitsubishi Gas Chemical Company Inc.) | 300 parts |
| Antioxidant (the following AO 1-1) | 6 parts |

TABLE 1

| Synthetic example No. | Pigment No. | Largest peak angle | Lowest peak angle | Peak at 9.4° | Peak at 9.6° | Peak between 7.3° and 9.4° | Peak at 24.0° | Peak at 26.3° | Remarks |
|---|---|---|---|---|---|---|---|---|---|
| 1 | Pigment 1 | 27.2° | 7.3° | Present | Present | Non-present | Present | Non-present | Inventive |
| 2 | Pigment 2 | 27.2° | 7.3° | Present | Present | Non-present | Present | Non-present | Inventive |
| 3 | Pigment 3 | 27.2° | 7.3° | Present | Present | Non-present | Present | Non-present | Inventive |
| 4 | Pigment 4 | 27.2° | 7.3° | Present | Present | Non-present | Present | Non-present | Inventive |
| 5 | Pigment 5 | 27.2° | 7.3° | Non-present | Non-present | Non-present | Present | Non-present | Comparative |
| 6 | Pigment 6 | 27.2° | 9.6° | Present | Present | Non-present | Present | Non-present | Comparative |
| 7 | Pigment 7 | 27.2° | 7.3° | Present | Present | Present (7.5°) | Present | Non-present | Comparative |
| 8 | Pigment 8 | 27.2° | 7.4° | Non-present | Non-present | Present (9.2°) | Present | Present | Comparative |

-continued

| | |
|---|---|
| THF/Toluene mixed liquid (mixture of 3/1 in volume ratio) | 2000 parts |
| Silicone oil (KF-50: produced by Shin-Etsu Chemical Co., Ltd.) | 1 Part |

The above-described compositions were mixed and dissolved to prepare charge transport layer coating solution 1. This coating solution was applied on the foregoing charge generation layer by a dip coat method, followed by drying at 110° C. for 70 minutes to form charge transport layer 1 having a dry thickness of 20.0 μm, whereby photoreceptor 1 was prepared.

AO-1

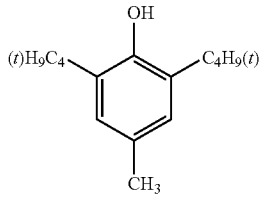

Preparation of Photoreceptors 2-22

Photoreceptors 2-22 were prepared similarly to the preparation of photoreceptor 1, except that the charge transport materials in the charge transport layers were changed as shown in Table 2.

In Table 2, CTM101 and CTM102 represent charge transport materials having the following structures.

(CTM101)

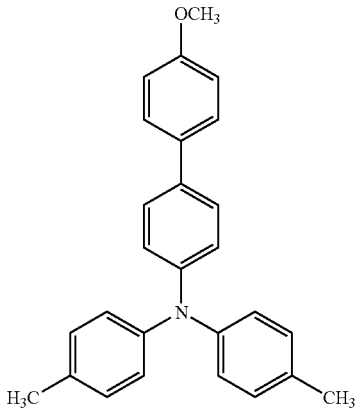

(CTM102)

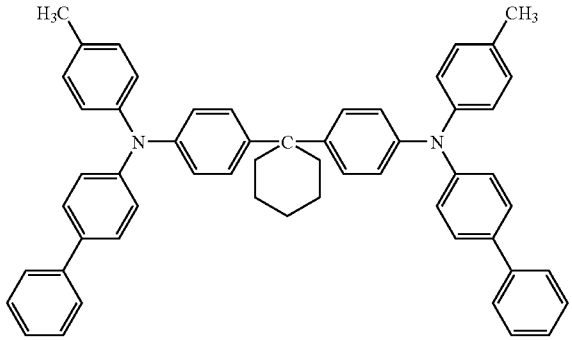

(Evaluation 1)

A photoreceptor obtained as described above was installed in a commercially available full-color multi-functional copier bizhub PRO C6500 (manufactured by Konica Minolta Business Technologies, Inc.) having a configuration shown in FIG. 2, which was modified so that the writing dot diameter could be changed. The exposure light diameter in the main scanning direction of the writing light source was 30 μm and 1200 dpi by using a laser light source emitting light of a wavelength of 405 nm. The spot exposure at the exposure light diameter was set at 0.5 mW on the photoreceptor surface. Since the above-described full-color composite copier possesses four sets of image forming units, photoreceptors in each of the image forming units are unified with the same kind of photoreceptors (for example, four pieces of photoreceptor 1 arranged in the case of photoreceptor 1) to make evaluations. Each evaluation was made at 20° C. and 60 RH %, after printing 50,000 sheets of A4 sized images having an image ratio of 7%.

<Evaluation Items and Evaluation Criteria>

Repetition Potential Stability

The Bk unit of aforementioned modified full color multi-functional copier bizhub PRO C6500 (manufactured by Konica Minolta Business Technologies, Inc.) was further modified so that the electric potential at the surface of the photoreceptor could be measured by providing a surface potential meter. The measurement was carried out as follows: the initial dark potential (Vo) and the initial bright potential (Vi) were set at around −700 V and −200 V, respectively, and charging and developing were repeated 500,000 times to measure the variations of Vo and Vi (ΔVo, ΔVi), which were used as the index of the repetition potential stability. Minus of ΔVo or ΔVi represents a reduction of the potential and plus represents increase of a potential.

Transfer Memory

The transfer currents of aforementioned full color multi-functional copier bizhub PRO C6500 were set to two levels of 50 mA and 100 mA, and occurrence or non-occurrence of transfer memory was tested using an original image provided with a black belt on the top of the image under a low temperature-low humidity condition (10° C. and 15% RH).

A: No transfer memory occurred at neither 50 mA nor 100 mA (Excellent);

B: No transfer memory occurred at 50 mA but slight transfer memory occurred at 100 mA (Practically acceptable); and C: Transfer memory occurred at 50 mA (Not acceptable).

Image Evaluation

The evaluation of images was carried out using a modified full color multi-functional copier bizhub PRO C6500 (a semiconductor laser emitting light of a wavelength of 405 nm was used as an imagewise exposure light source, and exposure of 1200 dpi at a beam diameter of 30 μm was conducted), while each of photoreceptors 1-22 was installed in the copier. The evaluation items and evaluation criteria will be shown below.

Evaluation of One Dot Line

A one dot line and a solid black image was formed on white A4 size paper, and evaluated according to the following criteria.

A: The one dot line is reproduced continuously and the image density of the solid black image is 1.2 or more (Excellent);

B: The one dot line is reproduced continuously but the image density of the solid black image is 1.0 or more but less than 1.2 (Practically acceptable); and C The one dot line is not reproduced continuously or, even if the one dot line is reproduced continuously, the image density of the solid black image is less than 1.0 (Not acceptable).

Evaluation of Two Dots Line

In a solid black image, a white two dots line was formed, and evaluated according to the following criteria.

A: The white two dots line is reproduced continuously and the image density of the solid black image is 1.2 or more (Excellent);

B: The white two dots line is reproduced continuously but the image density of the solid black image is 1.0 or more but less than 1.2 (Practically acceptable); and C The white two dots line is not reproduced continuously or, even if the white two dots line is reproduced continuously, the image density of the solid black image is less than 1.0 (Not acceptable).

The above-mentioned image density was measured using a densitometer RD-198 manufactured by Gretag Macbeth, GMB. A relative reflection density was measured by setting the reflection density of a white paper to "0". The results were shown in Table 2.

TABLE 2

| No. | Photoreceptor No. | Charge generation layer Charge generation material | Charge transport layer Charge transport material | Evaluation: Repetition potential stability ΔVo | ΔVi | Image property: Transfer memory | One dot line | Two dots line |
|---|---|---|---|---|---|---|---|---|
| Example 1 | 1 | Pigment 1 | CTM1 | −27 | 31 | B | B | B |
| Example 2 | 2 | Pigment 2 | CTM6 | −29 | 33 | B | B | B |
| Example 3 | 3 | Pigment 3 | CTM15 | −26 | 27 | B | B | B |
| Example 4 | 4 | Pigment 4 | CTM16 | −32 | 37 | B | B | B |
| Example 5 | 5 | Pigment 1 | CTM22 | −18 | 19 | A | A | A |
| Example 6 | 6 | Pigment 2 | CTM26 | −17 | 18 | A | A | A |
| Example 7 | 7 | Pigment 3 | CTM31 | −24 | 24 | B | B | A |
| Example 8 | 8 | Pigment 4 | CTM32 | −23 | 25 | B | B | A |
| Example 9 | 9 | Pigment 1 | CTM39 | −21 | 21 | B | B | A |
| Example 10 | 10 | Pigment 2 | CTM42 | −14 | 15 | B | A | A |
| Example 11 | 11 | Pigment 3 | CTM45 | −8 | 9 | A | A | A |
| Example 12 | 12 | Pigment 4 | CTM45 | −7 | 10 | A | A | A |
| Example 13 | 13 | Pigment 1 | CTM45 | −3 | 7 | A | A | A |
| Example 14 | 14 | Pigment 2 | CTM45 | −5 | 8 | A | A | A |
| Example 15 | 15 | Pigment 3 | CTM35 | −10 | 13 | B | A | A |
| Example 16 | 16 | Pigment 4 | CTM43 | −16 | 17 | B | B | B |
| Comparative 1 | 17 | Pigment 5 | CTM43 | −17 | 45 | C | B | B |
| Comparative 2 | 18 | Pigment 6 | CTM43 | −19 | 47 | C | B | B |
| Comparative 3 | 19 | Pigment 7 | CTM43 | −21 | 39 | C | B | B |
| Comparative 4 | 20 | Pigment 8 | CTM43 | −19 | 38 | C | B | B |
| Comparative 5 | 21 | Pigment 1 | CTM101 | −45 | 215 | C | C | C |
| Comparative 6 | 22 | Pigment 2 | CTM102 | −53 | 194 | C | C | C |

As is clear from Table 2, each of photoreceptors 1-16 of the present invention showed excellent potential stability and suppression effect of transfer memory against short wavelength laser light of 350-500 nm, and, as the result, an excellent result was also obtained with respect to the dot reproducibility in the image evaluation.

On the other hand, each of photoreceptors 17-20 in which a pigment in the charge generation layer was out of the range of the present invention showed insufficient suppression effect of transfer memory, and photoreceptors 21 and 22 in which CTM101 and CTM102 which were out of the range of the present invention were contained in the charge transport layers showed problems in dot reproducibility and potential stabilities, in addition to the problems in transfer memory.

What is claimed is:

1. An electrophotographic photoreceptor comprising an electrically conductive support having thereon a photo sensitive layer having a laminated structure comprising a charge generation layer and a charge transport layer, wherein the charge generation layer comprises a titanyl phthalocyanine pigment having a crystal structure exhibiting the following peaks of Bragg angles 2θ (±0.2°) of X-ray powder diffraction employing a characteristic X-ray of a CuKα radiation (having a wavelength of 1.542 Å):

at least a largest diffraction peak at 27.2°, major diffraction peaks at 9.4°, 9.6° and 24.0°, and a diffraction peak of a lowest angle at 7.3° while exhibiting no peak between the peaks of 7.3° and 9.4° and no peak at 26.3°; and the charge transport layer comprises a compound represented by Formula (1) or (2):

Formula (1)

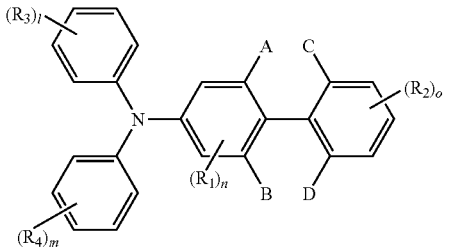

wherein $R_1$ and $R_2$ each represent an alkyl group having 1-5 carbon atoms or an alkoxy group having 1-5 carbon atoms; $R_3$ and $R_4$ each represent a substituted or non-substituted alkyl group having 1-5 carbon atoms or a substituted or non-substituted alkoxy group having 1-5 carbon atoms; n represents an integer of 0-2; o represents an integer of 0-3; l and m each represent an integer of 0-5; and A, B, C and D each represent a hydrogen atom, a substituted or non-substituted alkyl group, a substituted or non-substituted alkoxy group or a substituted or non-substituted aryl group, provided that A, B, C and D are not simultaneously a hydrogen atom, Formula (2)

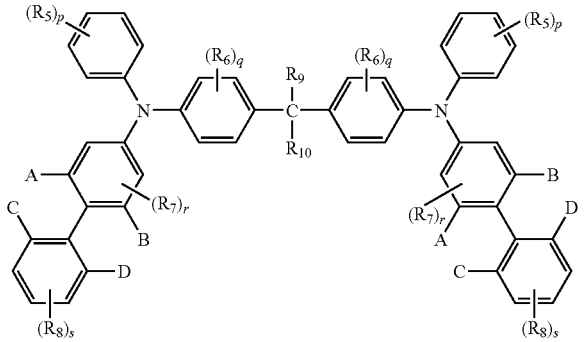

wherein $R_5$, $R_6$, $R_7$ and $R_8$ each represent an alkyl group having 1-5 carbon atoms or an alkoxy group having 1-5 carbon atoms; p represents an integer of 0-5; q represents an integer of 0-4; r represents an integer of 0-2; s represents an integer of 0-3; $R_9$ and $R_{10}$ each represent an alkyl group or an aryl group; $R_9$ and $R_{10}$ may be combined to form a ring; and A, B, C and D each are the same as A, B, C and D, respectively, defined in Formula (1), provided that A, B, C and D are not simultaneously a hydrogen atom.

2. The electrophotographic photoreceptor of claim 1 comprising an intermediate layer containing at least N-type semiconductor particles between the electroconductive support and the charge generation layer.

3. The electrophotographic photoreceptor of claim 1, wherein, in Formulas (1) and (2), only one of A, B, C and D is not a hydrogen atom.

4. The electrophotographic photoreceptor of claim 1, wherein $R_9$ and $R_{10}$ in Formula (2) are combined to form a ring.

5. The electrophotographic photoreceptor of claim 4, wherein the ring is a cyclohexyl ring or a cyclopentyl ring.

6. The electrophotographic photoreceptor of claim 1, wherein the charge generation layer comprises a binder; and a content of the titanyl phthalocyanine pigment in the charge generation layer is 20-600 parts by mass, based on 100 parts by mass of the binder.

7. The electrophotographic photoreceptor of claim 6, wherein the content of the titanyl phthalocyanine pigment is 50-400 parts by mass, based on 100 parts by mass of the binder.

8. The electrophotographic photoreceptor of claim 1, wherein the charge generation layer comprises at least one selected from the group consisting of a formal resin, a butyral resin, a silicone resin, a silicone modified butyral resin and a phenoxy resin, as a binder.

9. The electrophotographic photoreceptor of claim 1, wherein the charge transport layer comprises a binder; and a content of the compound represented by Formula (1) or (2) in the charge transport layer is 50-200 parts by mass, based on 100 parts by mass of the binder.

10. The electrophotographic photoreceptor of claim 9, wherein the content of the compound represented by Formula (1) or (2) is 50-100 parts by mass, based on 100 parts by mass of the binder.

11. The electrophotographic photoreceptor of claim 1, wherein the charge transport layer comprised the compound represented by Formula (1).

12. The electrophotographic photoreceptor of claim 1, wherein the charge transport layer comprised the compound represented by Formula (2).

13. A method of image forming comprising the steps of:

providing a uniform charge potential over an electrophotographic photoreceptor;

exposing the electrophotographic photoreceptor provided with the charge potential to light having a wavelength of 350-500 nm to form an electrostatic latent image;

developing the electrostatic latent image to form a toner image; and transferring the toner image to a transfer medium, wherein the electrophotographic photoreceptor of claim 1 is employed as the electrophotographic photoreceptor.

14. An image forming apparatus employing the method of image forming of claim 13.

15. A process cartridge used for an image forming apparatus employing a method of image forming comprising the steps of:

providing a uniform charge potential over an electrophotographic photoreceptor;

exposing the electrophotographic photoreceptor provided with the charge potential with light having a wavelength of 350-500 nm to form an electrostatic latent image;

developing the electrostatic latent image to form a toner image; and transferring the toner image to a transfer medium, wherein the electrophotographic photoreceptor of claim 1 is employed as the electrophotographic photoreceptor, wherein the process cartridge comprises the electrophotographic photoreceptor and at least one of a charging member, an imagewise exposing member and a developing member to be unified in a body; and the process cartridge is designed so as to be easily installed into or removed from the image forming apparatus.

* * * * *